US005459498A

United States Patent [19]

Seccombe et al.

[11] Patent Number: 5,459,498

[45] Date of Patent: Oct. 17, 1995

[54] INK-COOLED THERMAL INK JET PRINTHEAD

[75] Inventors: Dana Seccombe, Foster City, Calif.; Niels J. Nielsen, Corvallis, Oreg.; May Fong-Ho, La Mesa, Calif.; King-Wah W. Yeung, Cupertino, Calif.; Lawrence A. Hand, Palo Alto, Calif.

[73] Assignee: Hewlett-Packard Company, Palo Alto, Calif.

[21] Appl. No.: 982,813

[22] Filed: Nov. 30, 1992

Related U.S. Application Data

[63] Continuation-in-part of Ser. No. 694,185, May 1, 1991, Pat. No. 5,168,284.

[51] Int. Cl.[6] ..... B41J 2/05; B41J 29/377

[52] U.S. Cl. ..... 347/18

[58] Field of Search ..... 346/1.1, 140 R; 400/719; 165/104.33; 347/18, 17, 65

[56] References Cited

U.S. PATENT DOCUMENTS

| | | | |
|---|---|---|---|
| 4,262,188 | 4/1981 | Beach | 346/76 PH X |
| 4,313,684 | 2/1982 | Tazaki et al. | 346/140 R X |
| 4.490,728 | 12/1984 | Vaught et al. | 346/1.1 |
| 4,510,507 | 4/1985 | Ishikawa | 346/76 PH |
| 4,791,435 | 12/1988 | Smith et al. | 346/410 R |
| 4,910,528 | 3/1990 | Firl et al. | 346/1.1 |
| 5,066,964 | 11/1991 | Fukunda et al. | 346/140 R |
| 5,084,713 | 1/2892 | Wong | 346/1.1 |
| 5,107,276 | 4/1992 | Kneezel et al. | 346/1.1 |
| 5,109,234 | 4/1992 | Otis, Jr. et al. | 346/1.1 |
| 5,168,284 | 12/1992 | Yeung | 346/1.1 |
| 5,216,446 | 6/1993 | Satoi et al. | 346/140 R |

FOREIGN PATENT DOCUMENTS

| | | |
|---|---|---|
| 59-76275 | 10/1982 | Japan . |
| 4-131253 | 5/1992 | Japan . |

*Primary Examiner*—Joseph W. Hartary
*Assistant Examiner*—Alrick Bobb
*Attorney, Agent, or Firm*—Edward Maker, II.; Ron Griffin

[57] ABSTRACT

An ink-cooled thermal ink jet printhead has an efficient heat exchanger located on the back side of the printhead that eliminates the need for heat sinks. All ink flowing to the firing chamber goes through the heat exchanger. The geometry of the heat exchanger is chosen so that almost all the residual heat absorbed by the printhead substrate is transferred to the ink as it flows to the firing chamber. Additionally, the pressure drop of the ink flowing through the heat exchanger is low enough so that it does not significantly reduce the refill rate of the firing chambers. The heat exchanger can have one or more active heat exchanger sides. The heat exchanger has little thermal mass itself and significantly reduces the thermal mass of printhead by eliminating the need for a heat sink. This reduces the warm-up time of the printhead to a fraction of a second.

25 Claims, 16 Drawing Sheets

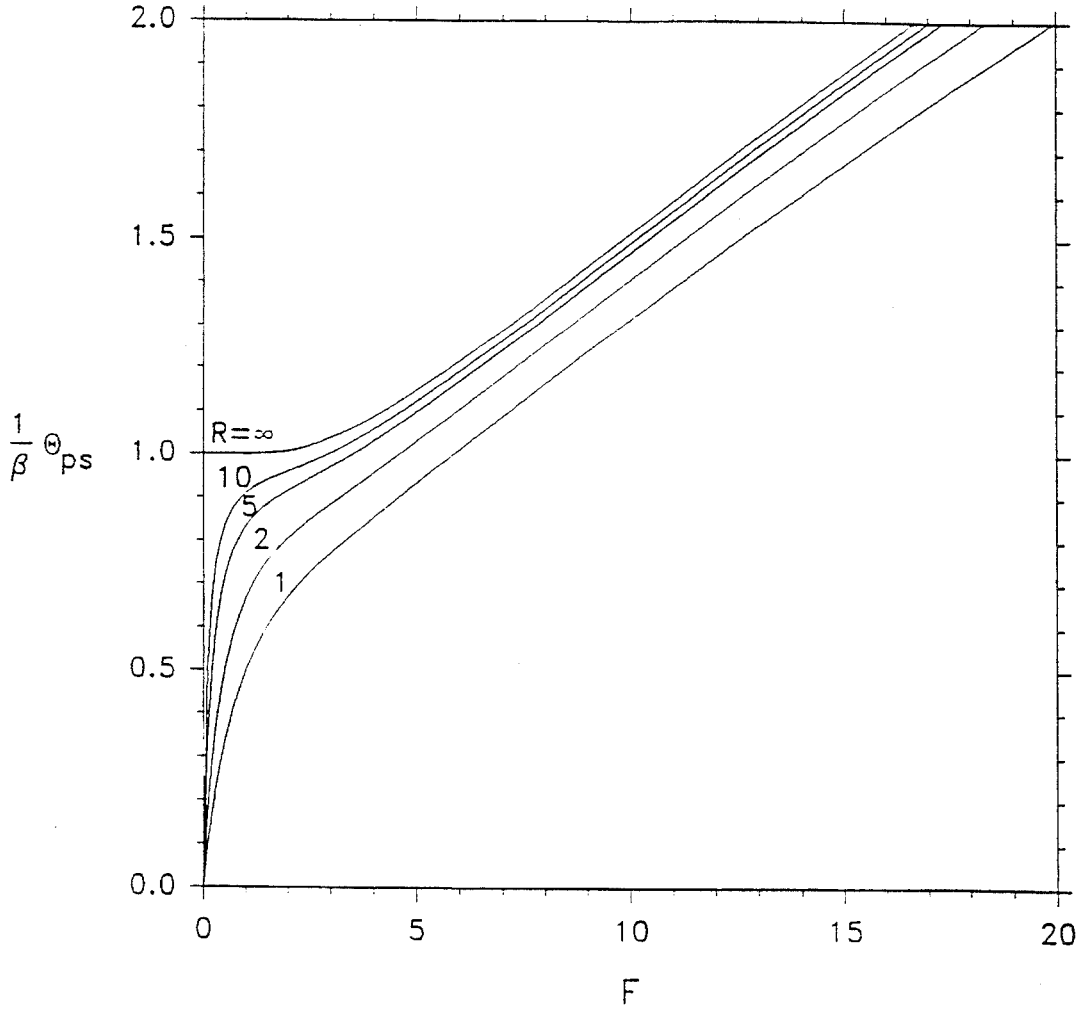
Fugure 9B

INK-COOLED THERMAL INK JET PRINTHEAD

This is a continuation-in-part of Ser. No. 694,185, filed May 1, 1991, now U.S. Pat. No. 5,168,284 issued Dec. 1, 1992 entitled METHOD AND APPARATUS FOR CONTROLLING THE TEMPERATURE OF THERMAL INK JET AND THERMAL PRINTHEADS THROUGH THE USE OF NONPRINTING PULSES filed in the name of Yeung on May 1, 1991 and owned by the assignee of this application and incorporated herein by reference. This application relates to copending application Ser. No. 07/983,009 entitled METHOD AND APPARATUS FOR REDUCING THE RANGE OF DROP VOLUME VARIATION IN THERMAL INK JET PRINTERS filed in the name of Canfield et al. on Nov. 30, 1992 and owned by the assignee of this application and is incorporated herein by reference.

FIELD OF THE INVENTION

This invention relates generally to thermal ink jet printing and more particularly to thermal control of thermal ink jet printheads.

BACKGROUND OF THE INVENTION

Thermal ink jet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, Academic Press, San Diego, 1988) and by U.S. Pat. Nos. 4,490,728 and 4,313,684. Thermal ink jet printers produce high quality print, are compact and portable, and print quickly but quietly because only ink strikes the paper. The typical thermal ink jet printhead uses liquid ink (i.e., colorants dissolved or dispersed in a solvent). It has an array of precisely formed nozzles attached to a printhead substrate that incorporates an array of firing chambers which receive liquid ink from the ink reservoir. Each chamber has a thin-film resistor, known as a "firing resistor", located opposite the nozzle so ink can collect between it and the nozzle. When electric printing pulses heat the thermal ink jet firing resistor, a small portion of the ink adjacent to it vaporizes and ejects a drop of ink from the printhead. Properly arranged nozzles form a dot matrix pattern. Properly sequencing the operation of each nozzle causes characters or images to be printed upon the paper as the printhead moves past the paper.

High performance, high speed thermal ink jet printheads generate large quantities of heat. When printing at maximum output (i.e., in "black-out" mode in which the printhead completely covers the page with ink), the rate of heat generation by thermal ink jet printheads is comparable to that of small soldering irons. Some of the heat is transferred directly to the ink in the firing chamber, but the printhead substrate absorbs the balance of this energy which will be called the "residual heat". (The rate of residual heat generation will also be referred to as the "residual power".) The residual heat can raise the overall printhead temperature to values that cause the printhead to malfunction. Under extreme circumstances, the ink will boil with severe consequences.

Existing printheads require air cooling in steady-state operation. Heat sinks are used to reduce the thermal resistance between the printhead and the surrounding air, thus enabling rejection of the residual heat at an acceptable printhead temperature. Heat sinks have high thermal conductivity and large surface area. They may be specialpurpose devices (e.g., metal fins) or devices with a different primary function (e.g., a chassis). Often, an integral ("on-board") ink reservoir serves as a heat sink for the printhead.

Here, the term "heat sink" refers to any device used to reduce the steady-state thermal resistance between the printhead and the surrounding air. (It is not to be confused with purely capacitive devices which function only in a transient mode.) This thermal resistance is the sum of two components: (1) the thermal resistance between the printhead and the external surface that transfers the heat to the air and (2) the convective thermal resistance between the external heat transfer surface and the surrounding air. (For the heat sink to be effective, this sum must be substantially less than the convective thermal resistance between the printhead alone and the surrounding air.) The first resistance component depends on the internal constitution of the heat sink and various schemes are used to reduce its value. These include the use of high conductivity materials, short heat flow paths, thermal conductors of large cross-sectional area, fins extending into the integral ink reservoir, and/or a miniature pump to circulate ink from the integral reservoir past the printhead and back to the reservoir. The second resistance component is inversely proportional to the area of the external heat transfer surface. Generally, a heat sink is large if its total thermal resistance is low.

A disadvantage of heat sinks is that their steady-state heat transfer rate is proportional to the printhead temperature and this causes the printhead temperature to vary strongly with the firing rate. When the firing rate increases (decreases), the residual power increases (decreases) and the printhead temperature increases (decreases) until the rate of heat rejection is equal to the residual power. For each firing rate there is a different equilibrium temperature at which there is no net flow of heat into (out of) the printhead substrate. Since the firing rate varies widely during normal printer operation, large printhead temperature variations are expected.

Fluctuations in the printhead temperature produce variations in the size of the ejected drops because two properties that affect the drop size vary with printhead temperature: the viscosity of the ink and the amount of ink vaporized by the firing resistor. Drop volume increases with temperature and excessive temperatures will cause undesirable large drops and unwanted secondary drops. When printing in a single color (e.g., black), the darkness of the print varies with the drop size. In color printing, the printed color depends on the size of each of the primary color drops that create it. Thus, dependence of printhead temperature on firing rate can severely degrade print uniformity and quality. Also, a wide operating temperature range generally necessitates the use of an increased pulse energy to ensure proper ejection of cold and viscous ink and thus increases power consumption and decreases the life and reliability of the firing resistors.

The printhead temperature can be stabilized by adding heat to the substrate to maintain it at a temperature that is equal to the equilibrium temperature for its highest firing rate. In this case, a heat sink will require that, under all operating conditions, the sum of the residual power and the additional power be equal to the residual power at the maximum firing rate. This excessive power consumption is especially disadvantageous in battery operated printers.

Also, heat sinks have the disadvantages of adding significant thermal capacitance, mass, and volume to the printhead. The additional thermal capacitance increases the warm-up time of the printhead during which the print quality is degraded for the reasons discussed above. The mass of a heat sink large enough to cool a high-speed, high-performance printhead would impair the high speed capabilities of such a printhead by limiting its traverse accelerations. And the large volume of a heat sink is obviously undesirable for a moving part in a compact device. A heat sink consisting of the ink reservoir has the additional disadvantage of subjecting the ink supply to elevated temperatures for extended periods of time, thus promoting thermal degradation of the ink.

SUMMARY OF THE INVENTION

For the reasons previously discussed, it would be advantageous to have a high-speed, high-performance thermal ink jet printhead that operates at a constant low temperature independent of firing rate and does not require a heat sink.

The present invention is a printhead that does not require any air cooling for proper operation. It can be cooled entirely by the ink that flows through it and is subsequently ejected from it. This printhead has a high-efficiency heat exchanger on its substrate that transfers heat from the substrate to the ink flowing to the firing chamber. (This heat will be referred to as the "indirect heat" as opposed to the "direct heat" which is transferred directly from the firing resistor to the ink in the firing chamber.) Instead of a heat sink, there is a high thermal resistance between the printhead and its surroundings to minimize (versus maximize with a heat sink) heat loss via this path. This printhead can be used in conjunction with either an integral ink reservoir or a separate stationary reservoir that supplies ink to the printhead through a small flexible hose. However, only the latter configuration will realize the full benefit of the mass and size reductions resulting from the elimination of the heat sink.

In contrast to a heat sink, which transfers heat at a rate that is proportional to the printhead temperature but not directly dependent on the firing rate, a perfect heat exchanger would remove heat from the substrate at a rate proportional to the product of the substrate temperature and the firing rate. Since the residual power is proportional to the firing rate, this heat exchanger would allow a perfectly insulated printhead to stabilize at a single low equilibrium temperature that is independent of the firing rate. This ideal performance can be closely approximated in an actual printhead while satisfying realistic design constraints. In other modes of operation, the performance of the heat exchanger is less than ideal but still vastly superior to that of a heat sink. The heat exchanger produces a relatively small pressure drop in the ink stream so that it does not substantially affect the refill process (which is usually driven by small capillary pressures).

For steady-state temperature stability, the thermal resistance between the printhead and other parts of the system is unimportant as long as all thermal paths between the printhead and the surrounding air are highly resistive.

However, for rapid thermal transient response (e.g., warm-up), a high value of this resistance is required to isolate the relatively small thermal capacitance of the printhead from the large thermal capacitance of other parts of the system (e.g., an integral ink reservoir). In the absence of a heat sink, the thermal resistance between the printhead and the surrounding air is quite high. But both steady-state temperature stability and thermal transient response can be improved by adding thermal insulation to the printhead.

The printhead can be preheated at power-on by driving the firing resistors with non-printing pulses (i.e., pulses that transmit less energy than what is needed to eject a drop) or by a separate heating resistor. Similarly, either of these methods could be used to supply additional heat to the printhead at a rate that is proportional to the firing rate. This would raise the printhead operating temperature (and consequently the drop volume) by an increment that is independent of the firing rate and could thus function as a print darkness adjustment.

The ink-cooled printhead has numerous advantages over conventional printheads with heat sinks: The operating temperature remains low and nearly constant over a wide range of firing rates without additional power consumption or the complexity and expense of a control system. The ink flowing into the firing chamber has a nearly constant temperature and viscosity, thus enabling the printhead to consistently produce uniform high-quality print. The stable ink temperature enables the printhead to operate over a wide range of firing rates without using the increased pulse energy required to ensure proper ejection of cold and viscous ink. The nearly constant substrate and ink temperatures simplify the design and testing of the printhead which otherwise would have to be characterized over a broad temperature range. Significant reductions in the thermal capacitance, mass, and volume of the printhead allow it to warm up quickly, accelerate rapidly, and fit into confined spaces. Preheating power consumption is reduced because of the lower thermal capacitance and because the (insulated) printhead may cool more slowly when idling. The printhead could be maintained at operating temperature during idle periods with minimal additional power consumption. Alternatively, the printhead could be quickly heated to operating temperature after a long idle period. Unlike printheads that use the ink reservoir as a heat sink, the ink remains cool until it is heated immediately prior to ejection, thus avoiding thermal degradation. The ink-cooled printhead operates at a nearly constant temperature increment above the temperature of the ink reservoir and is therefore relatively insensitive to fluctuations in air temperature.

BRIEF DESCRIPTION OF THE DRAWINGS

FIGS. 9A, 9B, 9C, 9D, and 9E show the thermal performance characteristics of an ink-cooled thermal ink jet printhead employing a single-sided heat exchanger.

DETAILED DESCRIPTION OF THE INVENTION

A person skilled in the art will readily appreciate the advantages and features of the disclosed invention after reading the following detailed description in conjunction with the drawings.

Figure 1:
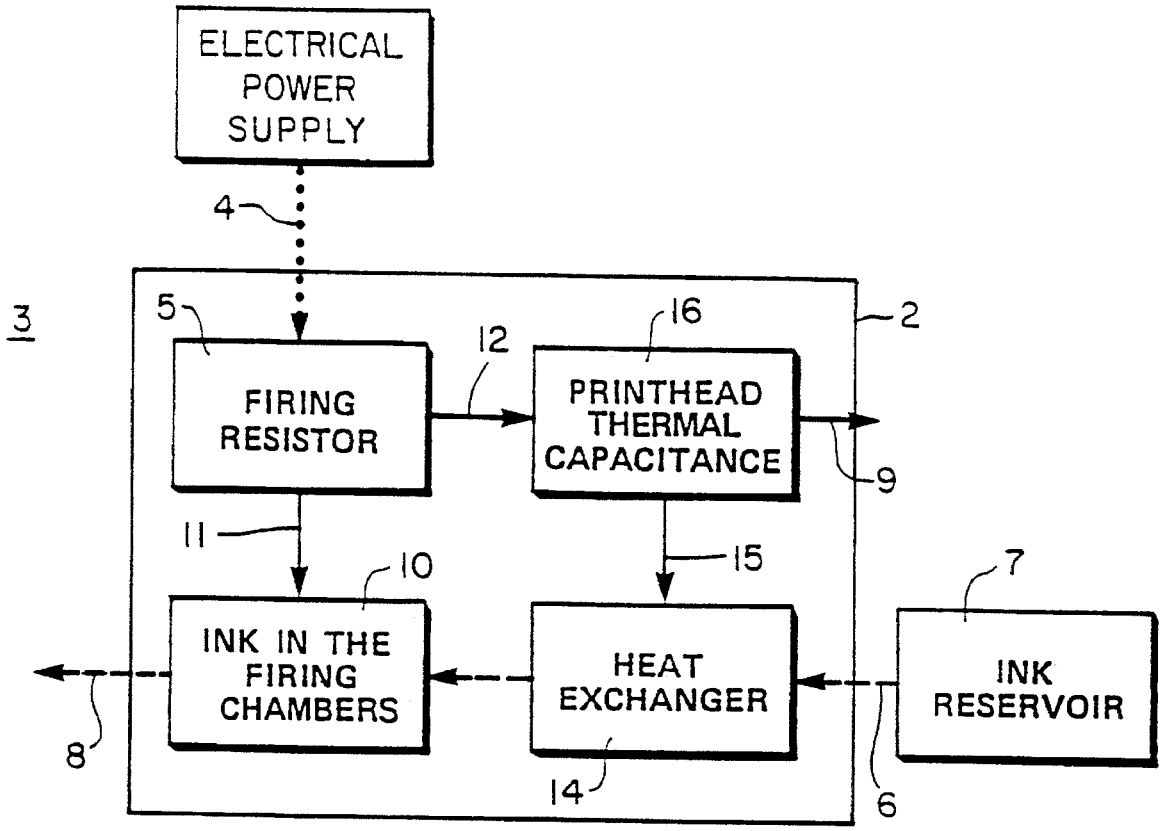
FIG. 1 shows the flow of energy and mass in a printhead made according to the preferred embodiment of the invention.

FIG. 1 shows the flow of energy and mass in a printhead made according to the preferred embodiment of the invention. The solid, dashed, and dotted lines in FIG. 1 represent the flow of heat, mass carrying thermal energy, and electrical energy, respectively. Instead of employing a heat sink, the printhead is thermally insulated 2 from its surroundings 3. The energy entering the printhead consists only of the electric energy 4 flowing to the firing resistors 5 and the thermal energy 6 carried by the ink stream from the ink reservoir 7. In the ideal case of perfect insulation, the energy leaving the printhead would consist only of the thermal energy 8 carried by the ejected drops. (The kinetic energy of the ejected drops is negligible.) Then, in steady-state operation, all of the electric energy flowing into the printhead would appear as a temperature rise in the ink flowing through the printhead. In the following discussion, this temperature difference is used as a reference value and will be referred to as the "characteristic temperature rise", $$\Delta T_c = \frac{e}{v\rho c} \tag{1}$$

where e is the pulse energy, v is the drop volume, is the ink density, and c is the ink specific heat.

Of course, a real printhead will have imperfect insulation and will transfer some heat to its surroundings. This will be called "rejected heat" 9 in FIG. 1. However, good insulation will limit this heat flow to a small fraction of the maximum power input. The consequences of this heat loss will be examined subsequently.

Some of the heat generated by the firing resistor is transferred directly to ink 10 in the firing chamber and will be called the "direct heat" 11 as shown in FIG. 1. The remaining heat is absorbed by the printhead substrate and will be called the "residual heat" 12. (The fraction of the energy input comprising residual heat will be referred to as the "residual heat fraction".) The heat exchanger 14 transfers heat from the substrate to the ink flowing from the reservoir to the firing chamber 6. This will be called the "indirect heat" 15. In steady-state operation, the printhead capacitance 16 does not absorb or release any heat and hence the residual heat is equal to the sum of the indirect heat and the rejected heat.

Figure 4:
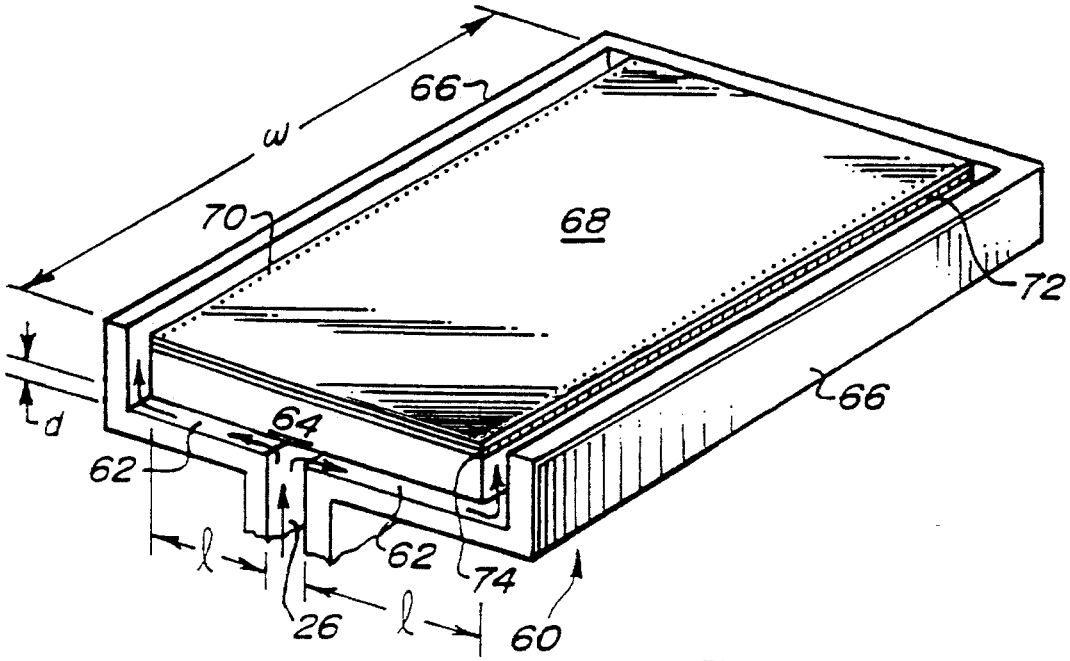
FIG. 4 is a drawing of an alternate embodiment of the invention.
Figure 2:
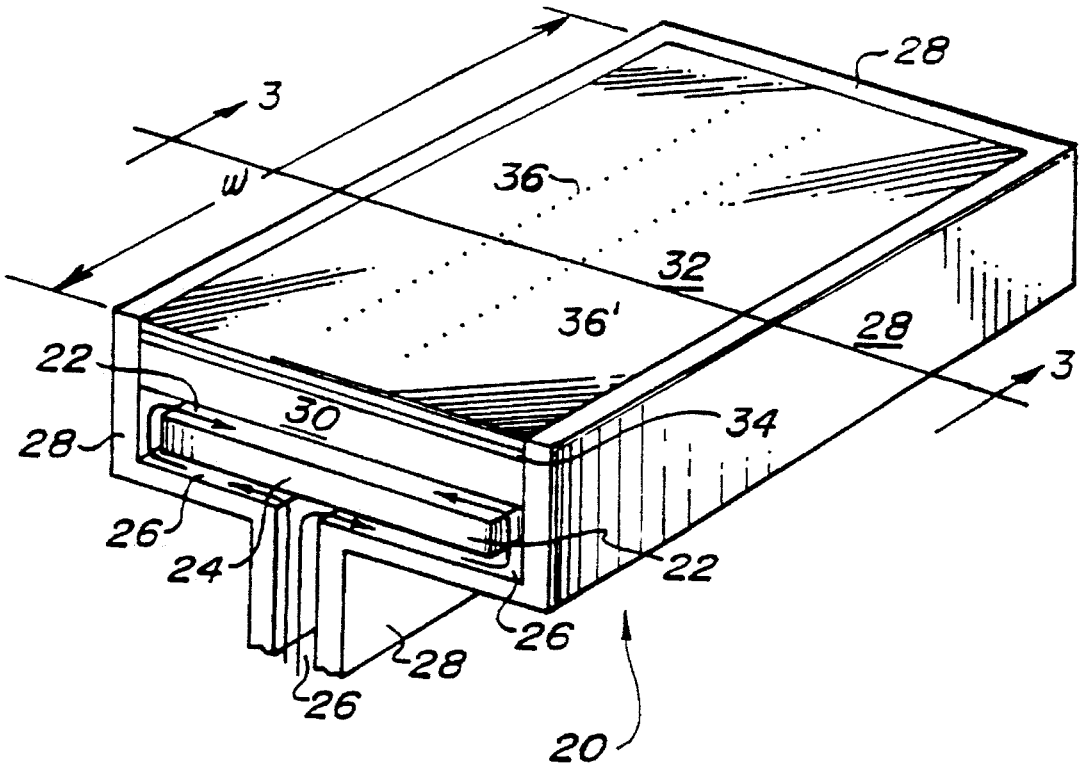
FIG. 2 is a drawing of the preferred embodiment of the invention with a portion of the outer thermal insulation removed.
Figure 3:
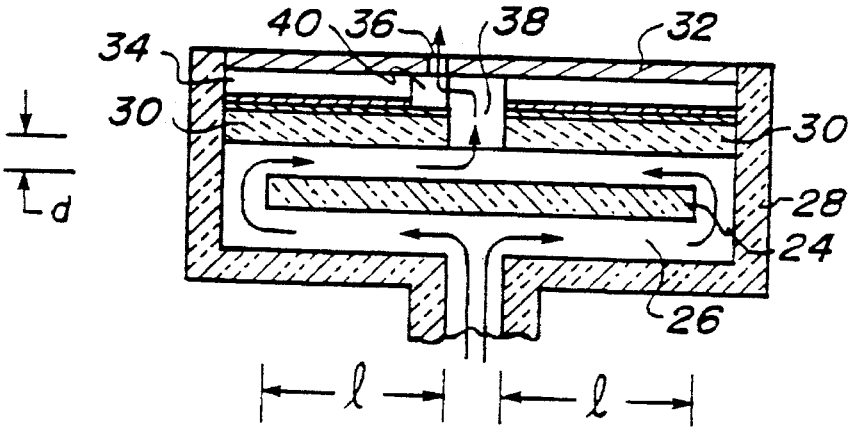
FIG. 3 shows a cross-section of the printhead shown in FIG. 2 taken across the middle of the printhead.
Figure 5:
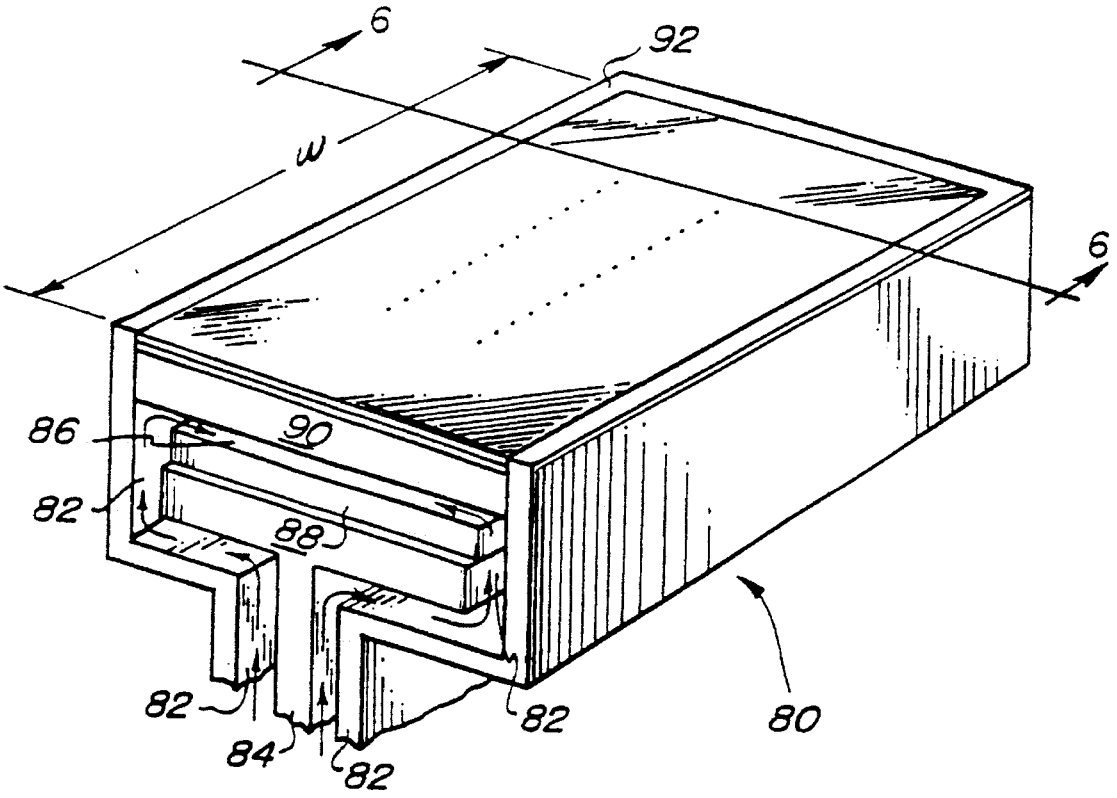
FIG. 5 is a drawing of an alternate embodiment of the invention, an ink-cooled thermal ink jet printhead with a double-sided heat exchanger.
Figure 6:
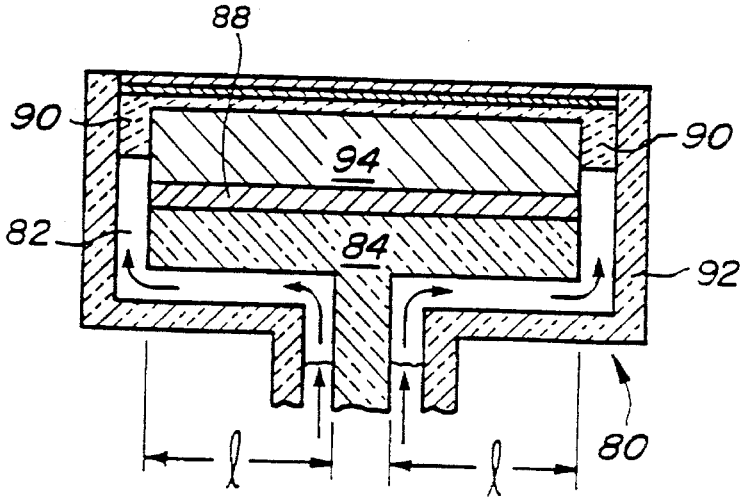
FIG. 6 shows a cross-section of the printhead at the intersection of the thermal conductor and the outer insulation of the printhead shown in FIG. 5.

The heat exchanger 14 consists of ink flowing in the narrow gap between two parallel plane surfaces, one of which is part of the bottom side of the printhead substrate. The other surface is either an essentially adiabatic wall (as shown in FIGS. 2, 3, and 4) or a thermally conductive wall that is directly coupled to the substrate (as shown in FIGS. 5 and 6). These configurations will be referred to as the "single-sided" and "double-sided" heat exchangers or equivalently, heat exchangers having one or two "active surfaces". The parallel-plane geometry is the preferred embodiment, but the scope of the invention includes heat exchangers of any configuration.

In the discussion that follows, certain physical assumptions are made only to facilitate an approximate mathematical analysis of the invention. These assumptions do not limit the scope of the invention in any manner.

The solid parts of the printhead are assumed to be at a spatially uniform temperature, $T_p$. (This is a valid approximation because of the small size and relatively high thermal conductivity of the printhead.) In this case, the performance of the heat exchanger can be characterized by its "efficiency", which is defined as follows:

$$\text{Efficiency} = E \equiv \frac{T_1 - T_0}{T_w - T_0} = \frac{T_1 - T_0}{T_p - T_0} \equiv \frac{\Delta T_1}{\Delta T_p} \tag{2}$$

$T_0$ is the temperature of the fluid entering the heat exchanger (e.g., the reservoir temperature), $T_w$ is the temperature of the heated wall(s) (i.e., the substrate temperature, $T_w = T_p$) and $T_1$ is the bulk temperature (a velocity-weighted spatial average temperature) of the fluid leaving the heat exchanger. The bulk temperature is proportional to the rate of thermal energy transport by the fluid and is equal to the fluid temperature that would result if the flow were collected in a cup and thoroughly mixed. For this reason, it is also called the "mixed-mean temperature" and "mixing-cup temperature". The efficiency is the ratio of the actual heat transfer to the maximum possible heat transfer and is thus equivalent to what is called "effectiveness" in the heat transfer literature.

At low flow rates, the fluid remains in the heat exchanger for sufficient time for the fluid temperature over the full depth of the channel to approach the wall temperature ($T_1 \cong T_w$, $E \cong 1$). In this case the rate at which heat is transferred is nearly proportional to the product of the temperature difference ($T_w - T_0$) and the flow rate. At higher flow rates, residence times are shorter, departures from thermal equilibrium are greater, and efficiencies are lower. However, if the wall temperature remains constant, the rate of heat transfer always increases with flow rate, despite the decreasing efficiency.

For purposes of analysis, it is assumed that the flow in the heat exchanger is laminar and two-dimensional with a fully-developed (parabolic) velocity profile and a uniform temperature profile ($T = T_0$) at the entrance. The velocity profile assumption appears warranted because the ink must flow through other similar narrow passages upstream of the heat exchanger. Additional justification for this assumption is provided by the following argument.

For most inks used in thermal ink jet printers, the Prandtl number, $$Pr \equiv \frac{\mu c}{k} >> 1 \quad (\text{Typically } 10 < Pr < 30) \tag{3}$$

where μ, c, and k represent the viscosity, specific heat, and thermal conductivity of the ink respectively. Since the Prandtl number represents the ratio of the rate of diffusion of momentum to the rate of diffusion of heat, this indicates that the velocity profile will develop much faster than the temperature profile. High-efficiency operation requires a highly developed temperature profile (i.e., fluid temperature nearly equal to $T_w$ over the full depth of the channel) at the heat exchanger exit. In that case, the high value of the Prandtl number implies that even if the velocity profile were completely undeveloped (i.e., uniform) at the heat exchanger entrance, it would develop in a relatively short distance from the entrance. Therefore, it can be concluded that the assumption of a fully developed velocity profile over the entire length of the heat exchanger is at least a valid approximation.

A newtonian fluid with constant properties is assumed. In the case of the viscosity, this is only an approximation, since it may vary significantly over the range of temperatures in the heat exchanger. With the further justifiable assumptions of negligible axial conduction, negligible viscous heat generation, and steady (or quasi-steady) operation, the efficiencies of both the single-sided and double-sided heat exchangers can be calculated using the analytical results obtained by McCuen. (P. A. McCuen, "Heat Transfer with Laminar and Turbulent Flow Between Parallel Planes with Constant and Variable Wall Temperature and Heat Flux" (Ph.D. Dissertation, Stanford University, 1962). See also R. K. Shah and A. L. London, *Laminar Flow Forced Convection in Ducts: A Source Book for Compact Heat Exchanger Analytical Data* (Academic Press, New York, 1978).) This analysis is essentially a solution of the thermal-hydrodynamic partial differential equation by the method of separation of variables. An eigen-function expansion is employed to satisfy the thermal boundary conditions at the channel walls and entrance.

In both the single-sided and double-sided cases, the efficiency can be expressed as a function of a single dimensionless variable:

$$A \equiv \frac{\frac{l}{2d}}{RePr} = \frac{\frac{l}{2d}}{\left(\frac{\rho u(2d)}{\mu}\right)\left(\frac{\mu c}{k}\right)} = \frac{\left(\frac{k}{\rho c}\right)l}{4(ud)d} = \frac{\alpha l}{4Q'd} \tag{4}$$

where l and d are the length and depth, respectively, of the heat exchanger; Re and Pr are the Reynolds and Prandtl numbers respectively; ρ, μ, c, k, and α are the density, viscosity, specific heat, thermal conductivity, and thermal diffusivity, respectively, of the ink; u is the mean flow velocity; and Q' is the volumetric flow rate per unit channel width. (The dimensionless variable A and the efficiency, E, are called $\bar{x}$ and $\theta_m$, respectively, by McCuen. The parts of his analysis that apply to the single-sided and double-sided heat exchangers are the laminar cases 3 and 1, respectively.)

Notice that in the above equation, both the aspect ratio and the Reynolds number are computed using the hydraulic diameter (the diameter of the circle having the same area-to-perimeter ratio as the channel cross-section), 2d, rather than the actual channel depth, d. (The flow will be laminar and stable as long as the Reynolds number is less than approximately 2300, as in the case of fully developed flow in a circular duct.) This Reynolds number is not to be confused with a Reynolds number based on axial length as employed in analyses of viscous flow over a flat plate in an infinite fluid.

Figure 7:
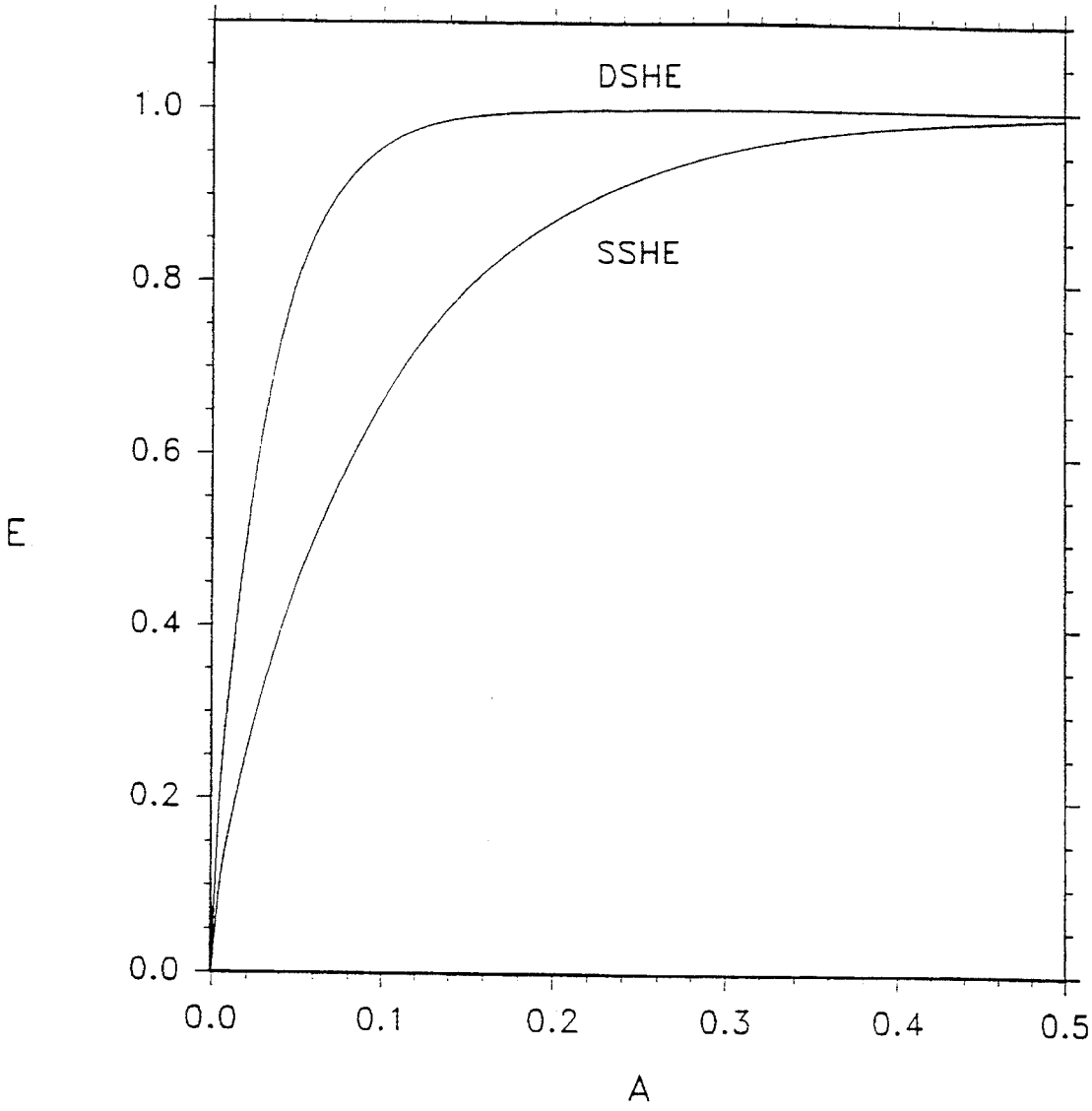
FIG. 7 is a plot of the efficiency, E, of the single-sided and double-sided heat exchangers, versus the dimensionless variable A. (E and A are defined by Equations 2 and 4, respectively.)

The results of this calculation are listed in Table 1 and shown graphically in FIG. 7. The data show variation of the efficiency with flow rate, channel length and depth, and fluid thermal diffusivity that is consistent with qualitative expectations. The thermal performance of the double-sided heat exchanger is clearly superior to that of its single-sided counterpart.

TABLE 1

Heat Exchanger Efficiency

| | E | | | E | |
|---|---|---|---|---|---|
| A | 1-sided | 2-sided | A | 1-sided | 2-sided |
| 0.000 | 0.0000 | 0.0000 | 0.160 | 0.8110 | 0.9927 |
| 0.005 | 0.1037 | 0.2074 | 0.170 | 0.8285 | 0.9946 |
| 0.010 | 0.1625 | 0.3250 | 0.180 | 0.8444 | 0.9960 |
| 0.015 | 0.2109 | 0.4206 | 0.190 | 0.8588 | 0.9970 |
| 0.020 | 0.2534 | 0.5020 | 0.200 | 0.8719 | 0.9978 |
| 0.025 | 0.2919 | 0.5717 | 0.210 | 0.8837 | 0.9984 |
| 0.030 | 0.3274 | 0.6317 | 0.220 | 0.8945 | 0.9988 |
| 0.035 | 0.3605 | 0.6832 | 0.230 | 0.9043 | 0.9991 |
| 0.040 | 0.3916 | 0.7276 | 0.240 | 0.9131 | 0.9993 |
| 0.045 | 0.4209 | 0.7657 | 0.250 | 0.9212 | 0.9995 |
| 0.050 | 0.4487 | 0.7985 | 0.260 | 0.9285 | 0.9996 |
| 0.055 | 0.4750 | 0.8267 | 0.270 | 0.9351 | 0.9997 |
| 0.060 | 0.5000 | 0.8510 | 0.280 | 0.9411 | 0.9998 |
| 0.065 | 0.5238 | 0.8718 | 0.290 | 0.9466 | 0.9999 |
| 0.070 | 0.5465 | 0.8898 | 0.300 | 0.9515 | 0.9999 |
| 0.075 | 0.5680 | 0.9052 | 0.320 | 0.9601 | 0.9999 |
| 0.080 | 0.5885 | 0.9185 | 0.340 | 0.9671 | 1.0000 |
| 0.085 | 0.6080 | 0.9299 | 0.360 | 0.9730 | 1.0000 |
| 0.090 | 0.6266 | 0.9397 | 0.380 | 0.9777 | 1.0000 |
| 0.095 | 0.6444 | 0.9481 | 0.400 | 0.9817 | 1.0000 |
| 0.100 | 0.6612 | 0.9554 | 0.420 | 0.9849 | 1.0000 |
| 0.110 | 0.6926 | 0.9670 | 0.440 | 0.9876 | 1.0000 |
| 0.120 | 0.7211 | 0.9756 | 0.460 | 0.9898 | 1.0000 |
| 0.130 | 0.7469 | 0.9820 | 0.480 | 0.9916 | 1.0000 |
| 0.140 | 0.7704 | 0.9867 | 0.500 | 0.9931 | 1.0000 |
| 0.150 | 0.7917 | 0.9901 | | | |

An additional important performance criterion is the pressure drop that results from flow through the heat exchanger. Again, assuming fully developed laminar flow of a newtonian fluid with constant properties, the pressure drop, in both the single-sided and the double-sided heat exchangers, is:

$$\Delta p = 12\frac{\mu u l}{d^2} = 12\frac{\mu Q' l}{d^3}. \tag{5}$$

A normalized pressure drop can be obtained by dividing by a reference pressure difference:

$$P \equiv \frac{\Delta p}{\Delta p_{ref}} = 12\frac{\mu Q' l}{d^3 \Delta p_{ref}}. \tag{6}$$

If the printhead is refilled by capillary pressure, this would be an appropriate choice for the reference pressure difference:

$$\Delta p_{ref} = \Delta p_c = \frac{4\gamma\cos\theta}{d_n} \tag{7}$$

where γ is the surface tension of the ink-air interface, θ is its angle of contact with the nozzle wall, and $d_n$ is the nozzle diameter. The capillary pressure is typically about ten centimeters of water and P represents the fraction of this pressure rise that drops across the heat exchanger. To avoid disruption of the refilling process, the pressure drop across the heat exchanger at maximum flow rate should typically be less than 2.5 centimeters of water, or P<0.25.

A special dimensionless length and depth can be formed:

$$L \equiv \left( \frac{\alpha^3 \Delta p_{ref}}{4\mu Q^4} \right)^{1/2} l \quad \text{and} \tag{8a}$$

$$D \equiv \left( \frac{\alpha \Delta p_{ref}}{4\mu Q^2} \right)^{1/2} d. \tag{8b}$$

These definitions are special because they allow both A and P to be expressed in terms of L and D:

$$A = \frac{L}{4D} \quad \text{and} \tag{9a}$$

$$P = \frac{3L}{D^3}. \tag{9b}$$

Figure 8A:
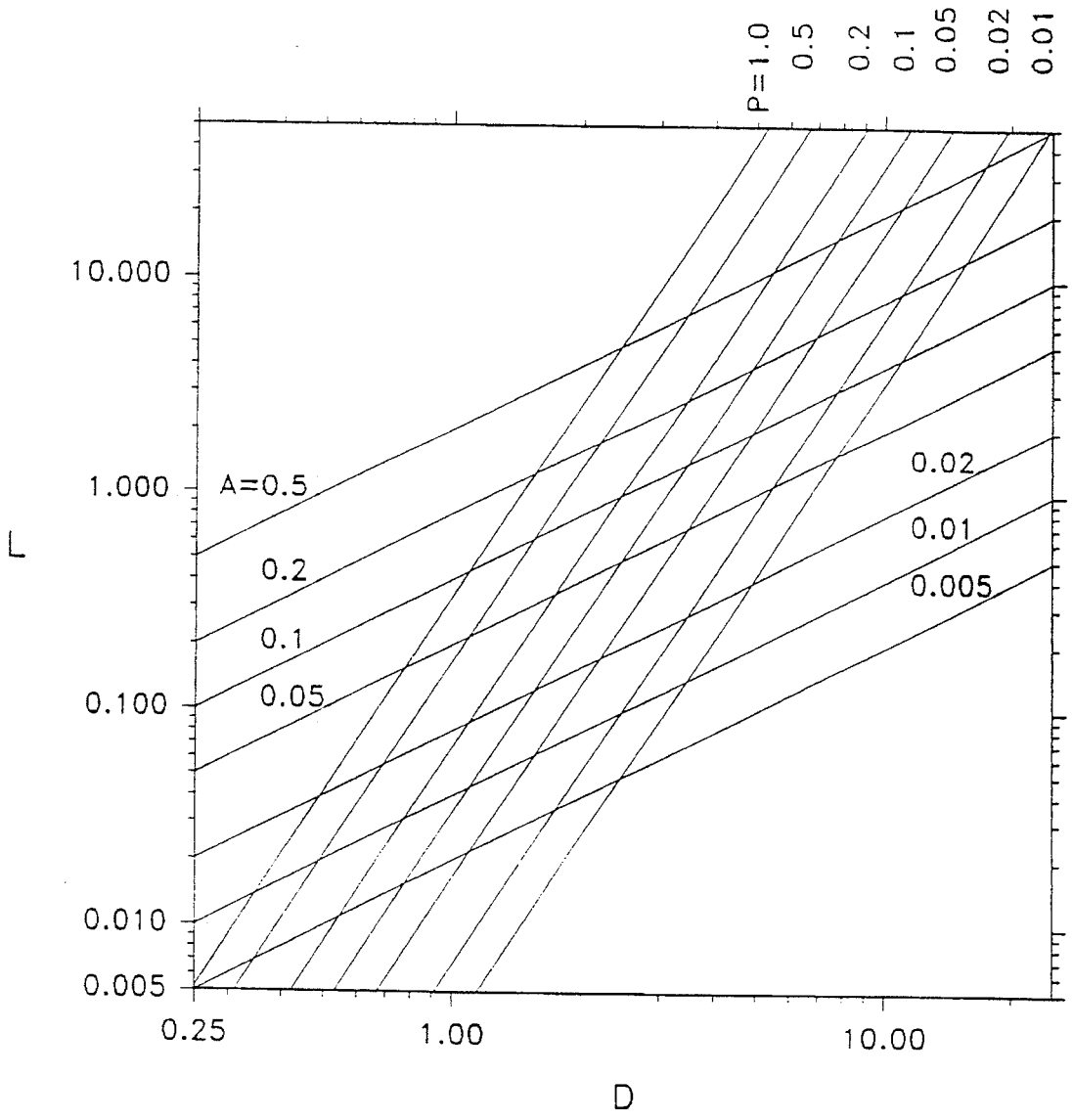
FIG. 8 is a logarithmic plot of the dimensionless length of the heat exchanger, L, versus the dimensionless depth of the heat exchanger, D, for various constant values of the dimensionless parameter A and the normalized pressure drop, P. (A, P, L, and D are defined by Equations 4, 6, 8a, and 8b, respectively.)
FIG. 8B is a logarithmic plot of the normalized pressure drop, P, versus the dimensionless variable A for various constant values of the dimensionless length of the heat exchanger, L, and the dimensionless depth of the heat exchanger, D. (A, P, L, and D are defined by Equations 4, 6, 8a, and 8b, respectively.)
Figure 8B:
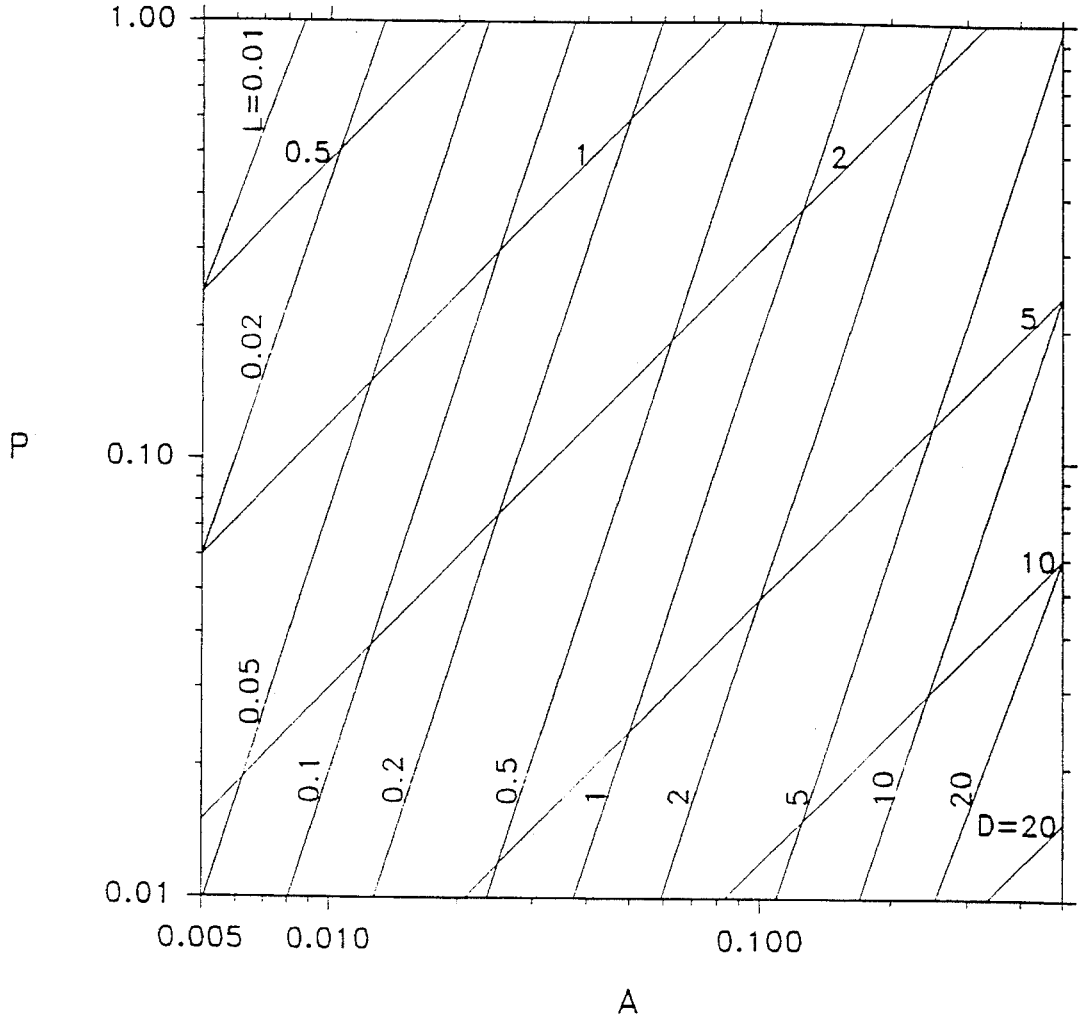

Thus, all of the equations relating to the design and performance of the heat exchanger can be represented graphically on a single plot of the type shown in FIG. 8A or 8B. Each design constraint can be represented as an area of the plot that is acceptable (e.g., A>0.1, L<2, and P<0.2). The intersection of all of these acceptable areas then represents all possible solutions to the heat exchanger design problem.

The analytical description of the heat exchanger can now be employed in a simple thermal model of the printhead. To simplify the analysis, it is assumed that the thermal resistance between the printhead and other parts of the writing system is much greater than the thermal resistance between these other parts and the surrounding air. In this case, the "surroundings" of the printhead (other parts and air) will all be at nearly the same ("ambient") temperature. Also, since the other parts of the system remain at a nearly constant temperature, their thermal capacitance will not significantly influence the thermal dynamics of the printhead.

The rates of flow of residual heat, indirect heat, and rejected heat can be expressed respectively:

$$q_{res} = \beta f e, \tag{10a}$$

$$q_{ind} = f v \rho c (T_1 - T_0) = f v \rho c E (T_p - T_0), \text{ and} \tag{10b}$$

$$q_{rej} = \frac{T_p - T_a}{r} \tag{10c}$$

where β is the residual heat fraction, f is the printhead firing rate (i.e., the sum of the firing frequencies for all of the nozzles), $T_a$ is the ambient temperature, and r is the thermal resistance between the printhead and its surroundings. The time rate of change of the printhead temperature is proportional to the rate of net heat flow into the printhead:

$$C \frac{dT_p}{dt} = q_{res} - q_{ind} - q_{rej} = \beta f e - f v \rho c E (T_p - T_0) - \frac{T_p - T_a}{r} \tag{11}$$

where C is the thermal capacitance of the printhead.

Reference values of thermal resistance and heat flow rate are defined respectively:

$$r_{ref} \equiv \frac{4d}{kbl} \quad \text{and} \tag{12a}$$

$$q_{ref} \equiv \frac{\Delta T_c}{r_{ref}} \equiv \frac{\left( \frac{e}{v\rho c} \right)}{\left( \frac{4d}{kbl} \right)} = \frac{kble}{4v\rho cd} \tag{12b}$$

where b represents the total flow width (e.g., b=2w if there are two channels, each of width w). $r_{ref}$ is equal to four times the static thermal resistance of the ink between the opposite walls of the heat exchanger. $q_{ref}$ is equal to the rate of heat flow that would result from a temperature difference equal to $\Delta T_c$ across a thermal resistance equal to $r_{ref}$.

Non-dimensional forms of the thermal resistance, firing rate, printhead-reservoir temperature difference, and ambient inlet temperature difference are defined respectively:

With these definitions, the differential equation (Equation 11) can be written in the following form:

$$\left( \frac{rC}{1 + RFE} \right) \frac{d\Theta_p}{dt} + \Theta_p = \frac{\beta RF + \Theta_a}{1 + RFE} \equiv \Theta_{ps} \tag{14}$$

where the efficiency, E, and the steady-state solution, $\theta_{ps}$, are functions of the firing rate. In general, the residual heat fraction, β, will depend, to some extent, on the printhead substrate temperature, but as an approximation, this dependence can be ignored over a limited temperature range. Also, quasi-steady operation of the heat exchanger is assumed. Under these conditions, Equation 14 is linear and analogous to an electrical low-pass filter with input $\theta_{ps}$, output $\theta_0$, and a time constant that depends on the input. The transient response to a step change in firing rate ($f_1$ to $f_2$ at t=0) is an exponential rise or decay:

$$\theta_p = \theta_{ps2} + (\theta_{ps1} - \theta_{ps2}) \exp(-t/\tau_2) \tag{15a}$$

where the subscripts 1 and 2 denote evaluation at $f_1$ and $f_2$ respectively and the time constant, $$\tau_2 = \frac{rC}{1 + RF_2E_2}. \tag{15b}$$

The time constant can be expressed in two non-dimensional forms:

$$\frac{\tau}{\tau_0} \equiv \frac{\tau}{rC} = \frac{1}{1 + RFE} \quad \text{and} \tag{16a}$$

$$\frac{\tau}{\tau_{ref}} \equiv \frac{\tau}{r_{ref}C} = R \frac{\tau}{rC} = \frac{R}{1 + RFE} \quad \text{and} \tag{16b}$$

The first form shows the variation of the time constant relative to its value when the firing rate is zero, but the second form is more useful for examining the effects of changing the thermal resistance.

The non-dimensional temperature rise of the ink leaving the heat exchanger is $$\Theta_1 \equiv \frac{\Delta T_1}{\Delta T_c} \equiv \frac{T_1 - T_0}{\Delta T_c} = E\Theta_p \tag{17a}$$

and its steady-state value is $$\Theta_{1s} = E\Theta_{ps} = \frac{\beta RFE + \Theta_a E}{1 + RFE}. \tag{17b}$$

The non-dimensional temperature rise of the ejected ink drops is $$\Theta_2 \equiv \frac{\Delta T_2}{\Delta T_c} \equiv \frac{T_2 - T_0}{\Delta T_c} = \Theta_1 + (1 - \beta) \tag{18b}$$

and its steady-state value is $$\Theta_{2s} = \Theta_{1s} + (1-\beta) = \frac{\beta RFE + \Theta_a E}{1 + RFE} + (1-\beta). \tag{18b}$$

Subject to the condition that $$\frac{T_a - T_0}{\Delta T_c} \equiv \Theta_a << \beta RF = \beta \frac{rfe}{\Delta T_c}, \tag{19}$$

the non-dimensional steady-state temperature expressions (Equations 14, 17b, and 18b) can be written in the following approximate (exact if $\theta_a$=0) form:

$$\frac{1}{\beta}\ \Theta_{ps} = \frac{RF}{1 + RFE}, \tag{20a}$$

$$\frac{1}{\beta}\ \Theta_{1s} = \frac{RFE}{1 + RFE}, \text{ and} \tag{20b}$$

$$\frac{1}{\beta}\ (1 - \Theta_{2s}) = 1 - \frac{1}{\beta}\ \Theta_{1s} = \frac{1}{1 + RFE} \tag{20c}$$

In the steady state, the fractions of the total printhead cooling that are provided by the ink (heat exchanger) and the surrounding air are, respectively, $$\frac{q_{ind}}{q_{res}} = \frac{fv\rho c(T_1 - T_0)}{\beta fe} = \frac{fv\rho c\Delta T_1}{\beta fv\rho c\Delta T_c} = \frac{1}{\beta}\ \frac{\Delta T_1}{\Delta T_c} = \frac{1}{\beta}\ \Theta_{1s} \tag{21a}$$

and $$\frac{q_{rej}}{q_{res}} = \frac{q_{res} - q_{ind}}{q_{res}} = 1 - \frac{q_{ind}}{q_{res}} = 1 - \frac{1}{\beta}\ \Theta_{1s} = \frac{1}{1 + RFE} \tag{21b}$$

Without air cooling, the minimum value of the efficiency for which boiling of the ink can be avoided is $$E_{min} = \frac{\beta \Delta T_c}{T_b - T_0} \tag{21c}$$

where $T_b$ is the boiling temperature of the ink. The value of $E_{min}$ is typically about 0.5.

Figure 9A:
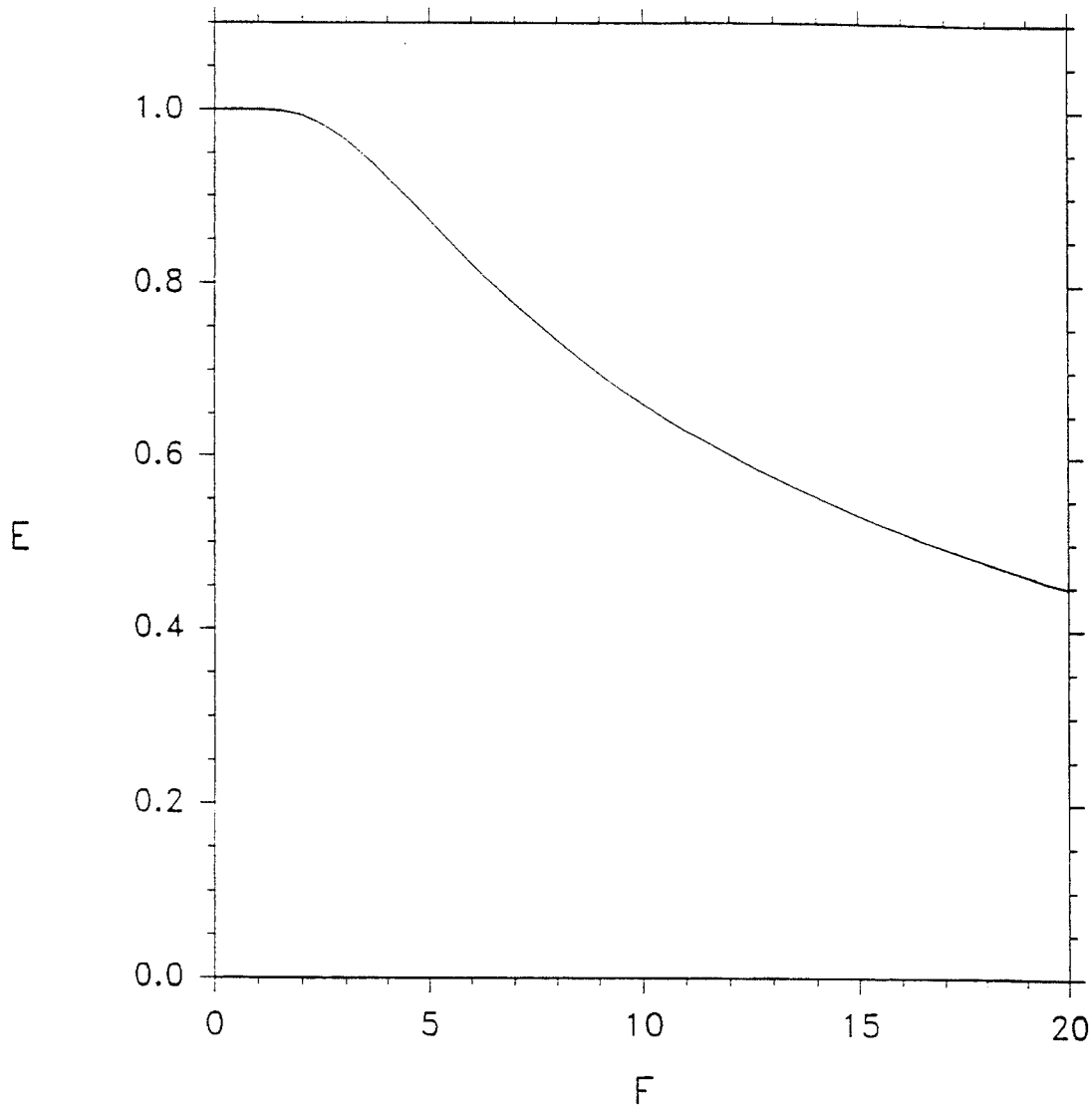
Figure 9C:
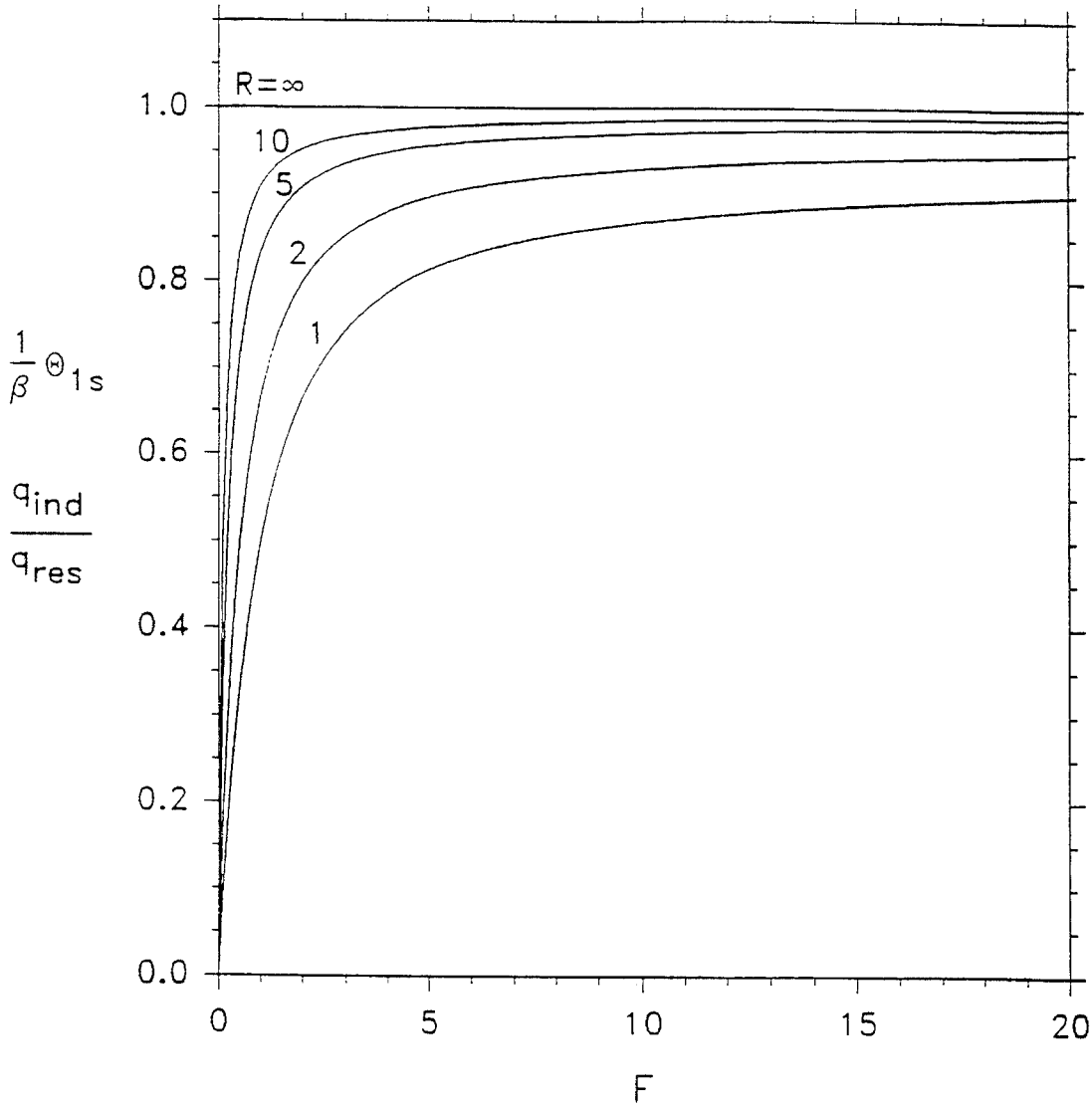
Figure 9D:
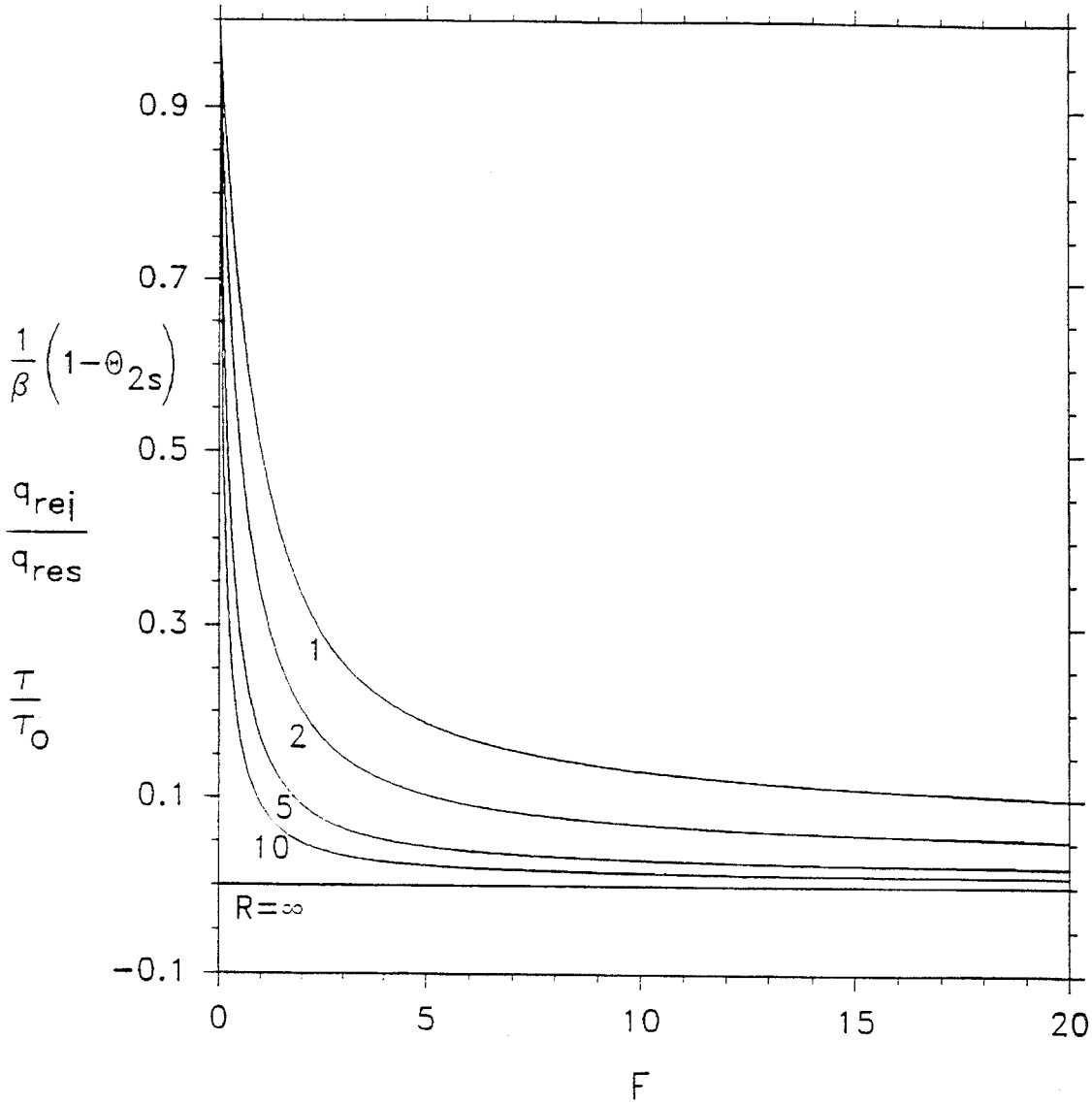
Figure 9E:
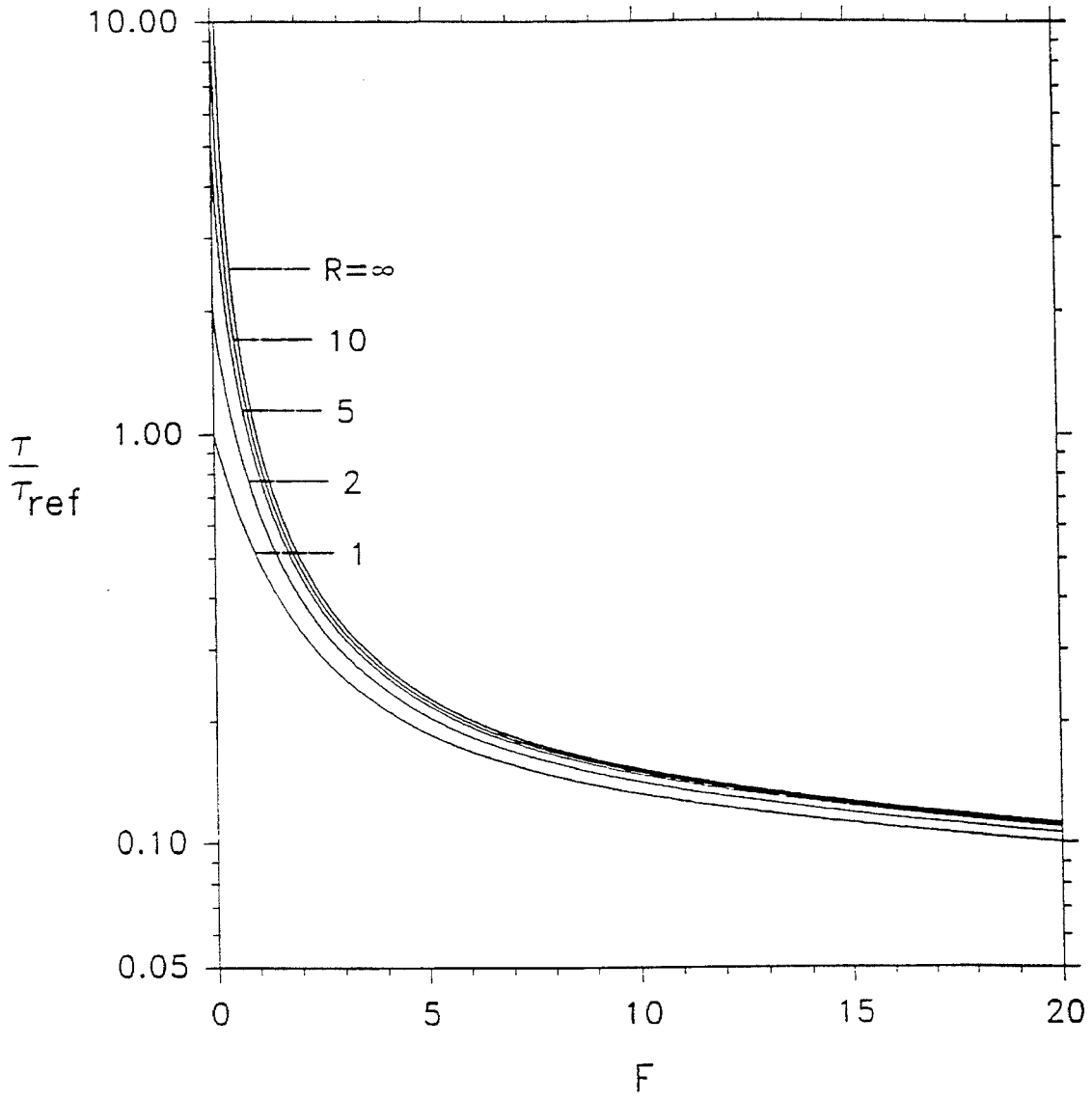
Figure 10A:
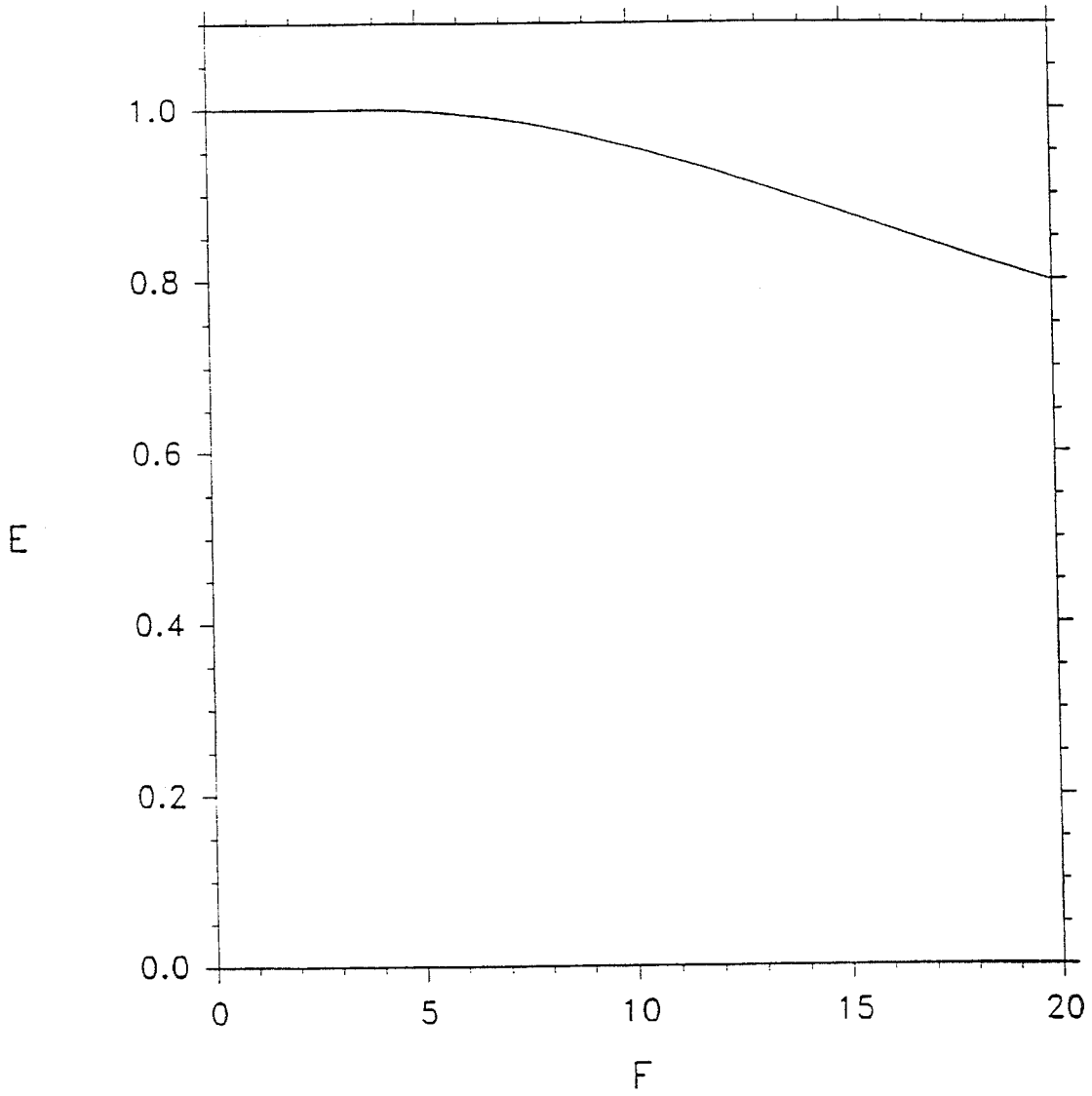
FIGS. 10A, 10B, 10C, 10D, and 10E show the thermal performance characteristics of an ink-cooled thermal ink jet printhead employing a double-sided heat exchanger.
Figure 10B:
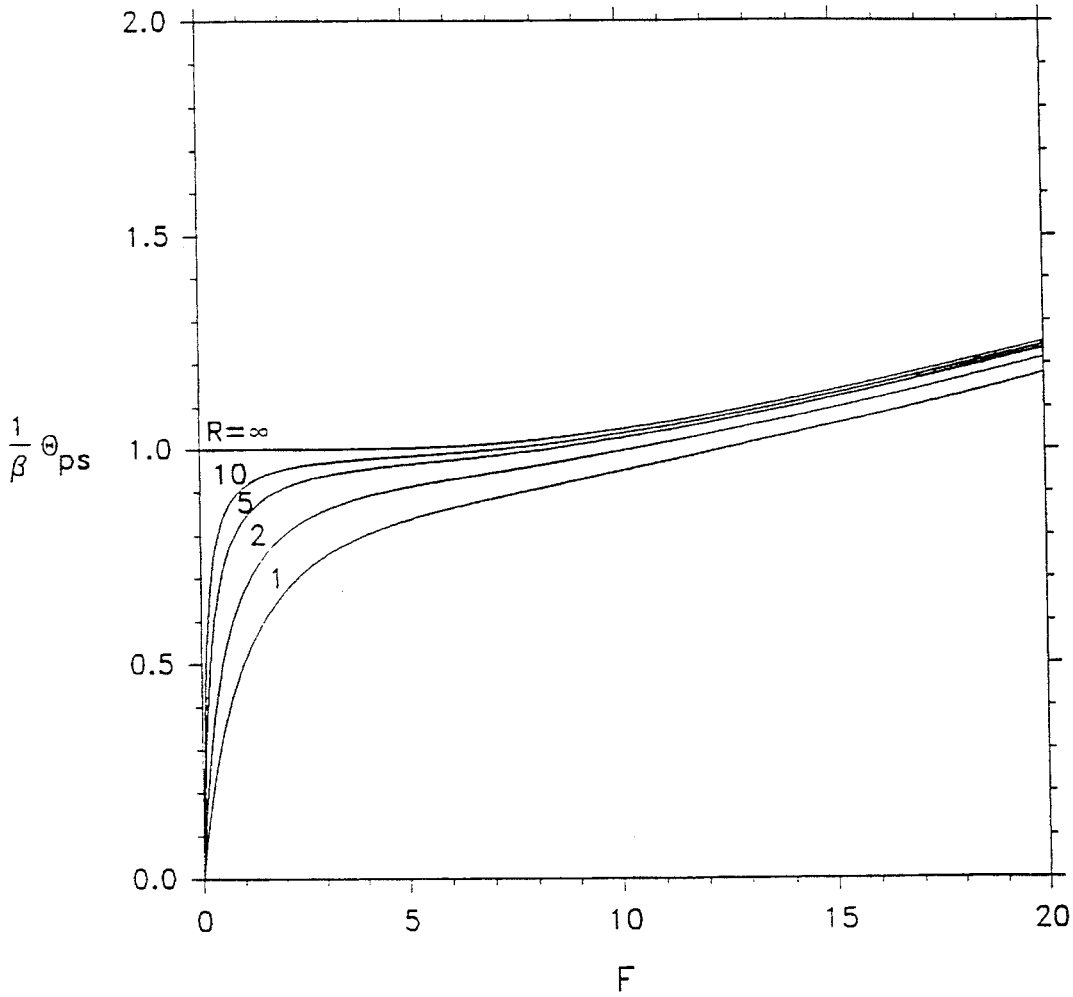
Figure 10C:
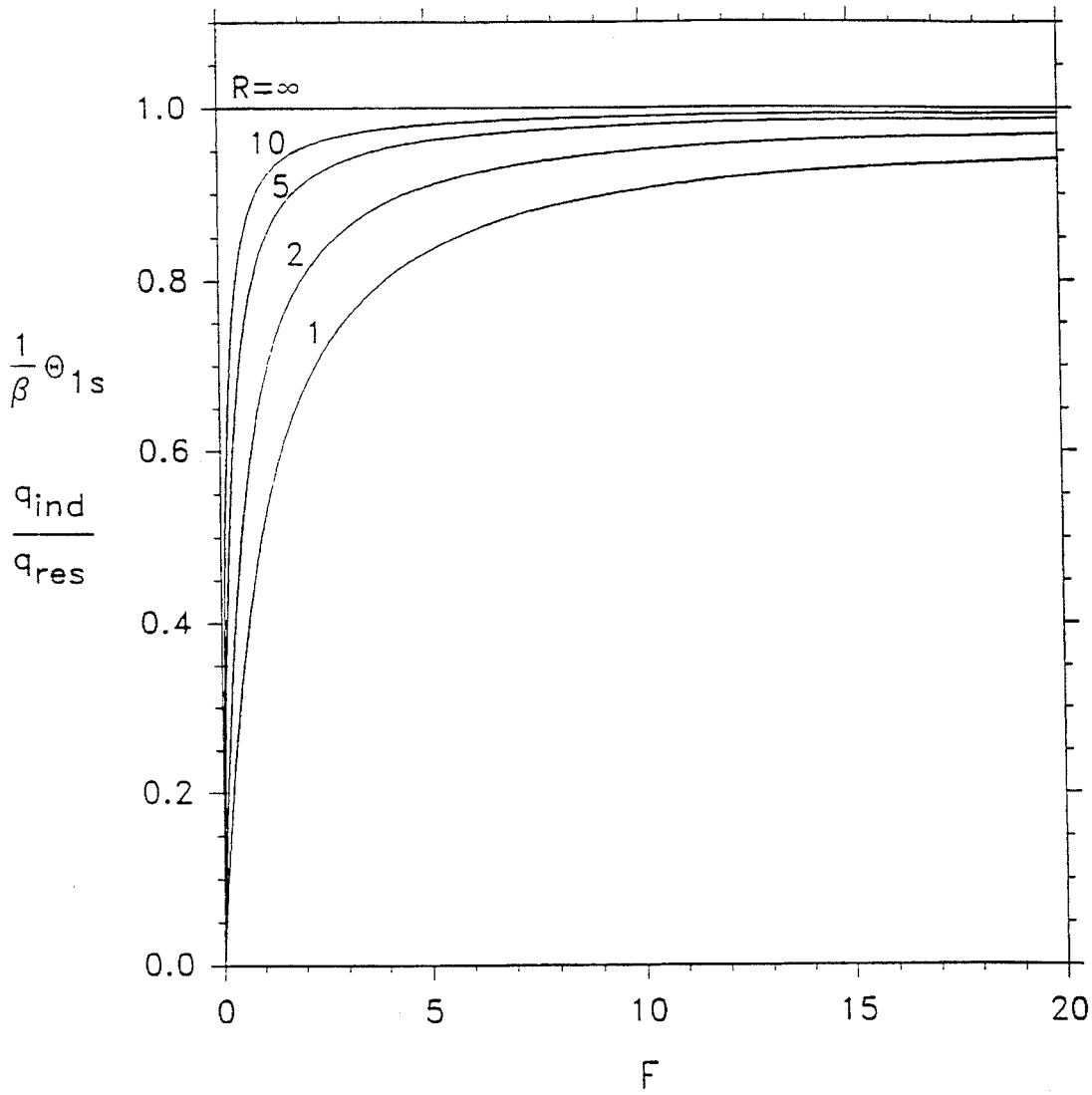
Figure 10D:
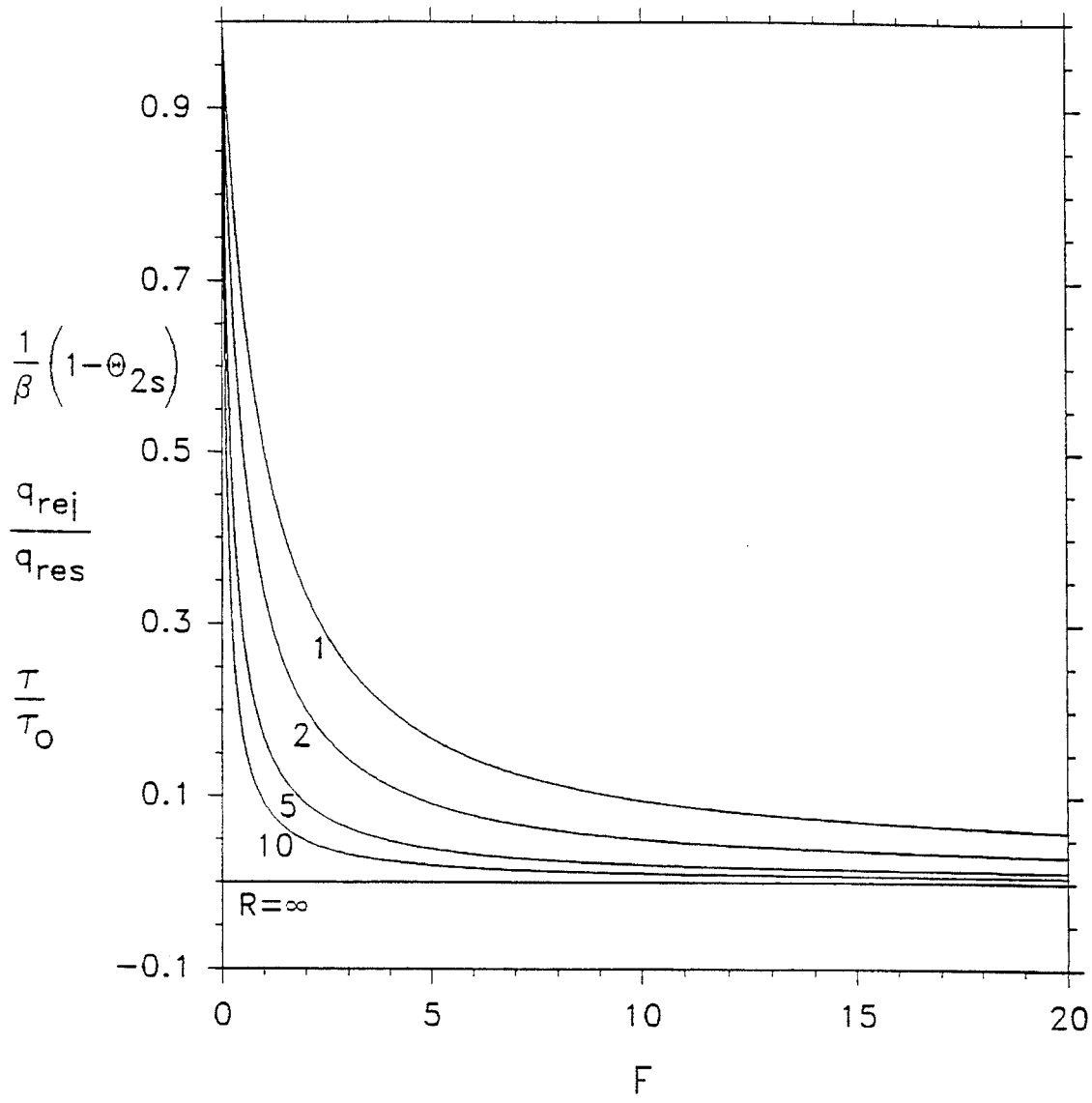

The efficiencies of the single-sided and double-sided heat exchanger as functions of the non-dimensional firing rate are shown graphically in FIGS. 9A and 10A, respectively. The three non-dimensional equations for the steady-state temperatures of the printhead, ink leaving the heat exchanger, and ejected ink drops (Equations 20a, 20b, and 20c) are represented graphically for the single-sided heat exchanger in FIGS. 9B, 9C, and 9D, respectively, and for the double-sided heat exchanger in FIGS. 10B, 10C, and 10D,respectively. The ink and air cooling fractions (Equations 21a and 21b) are shown graphically for the single-sided heat exchanger in FIGS. 9C and 9D, respectively, and for the double-sided heat exchanger in FIGS. 10C and 10D, respectively. The two non-dimensional time-constant expressions (Equations 16a and 16b) are represented graphically for the single-sided heat exchanger in FIGS. 9D and 9E and for the double-sided heat exchanger in FIGS. 10D and 10E.

FIGS. 9B, 9C, 9D, 10B, 10C, and 10D show clearly the advantages of low values of the non-dimensional firing rate, F, combined with a high value of the non-dimensional thermal resistance, R, in maintaining low and stable printhead and ink temperatures. These plots also show the substantial performance benefits of the double-sided heat exchanger and of a low value of the residual heat fraction, β.

In practice, the ink properties (ρ,c,k, and μ) and the values of the pulse energy, e, the drop volume, v, and the firing rate, f, may all be dictated by other (non-cooling) considerations. Consequently, the low values of F and the high value of R must be achieved by designing the heat exchanger to minimize the reference value of the thermal resistance, $r_{ref}$, and by maximizing the thermal resistance between the printhead and its surroundings, r. (See Equations 1, 12a, 12b, 13a, and 13b.) In this case, minimizing $r_{ref}$ is equivalent to maximizing the efficiency of the heat exchanger at the maximum flow rate.

In FIGS. 9C, 9D, 10C, and 10D the ink temperatures are nearly constant at large values of F, despite the increasing printhead temperature. But this apparent stability is deceptive since these are steady-state values only. The time constant is generally much greater than the residence time of the ink in the heat exchanger:

$$\tau >> \Delta t_r \equiv \frac{V}{Q} = \frac{bdl}{Q} = \frac{dl}{Q'} = \frac{l}{u} \tag{22}$$

where V is the internal volume of the heat exchange and Q is the volumetric flow rate. Hence, the heat exchanger will operate in a quasi-steady mode (as previously assumed) and its efficiency will respond much more rapidly to an abrupt change in firing rate than will the printhead temperature. In this case, there will be a transient ink-temperature disturbance nearly equal in magnitude (but opposite in sign) to the printhead temperature change (as indicated by Equations 17a and 18a). This is an additional reason why printhead temperature stability is important.

Figure 10E:
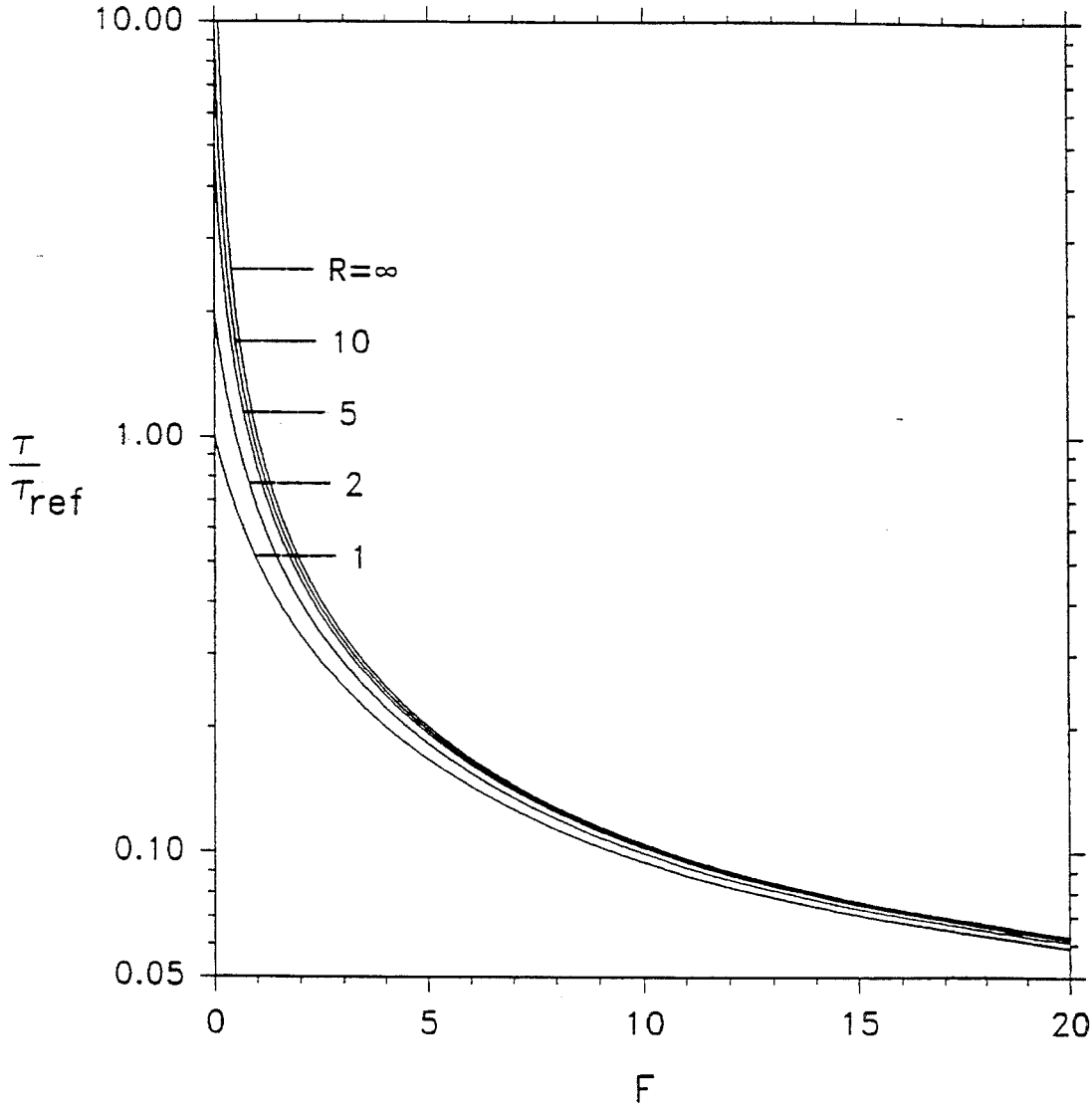

FIGS. 9D, 9E, 10D, and 10E show that the time constant increases as the firing rate decreases and has a very high value when the firing rate is zero. FIGS. 9E and 10E show that the time constant increases with the thermal resistance between the printhead and its surroundings-strongly at low firing rates and weakly at high firing rates. Hence, a high value of the thermal resistance results in a large range of time constants which can be used advantageously to allow rapid transient response at high firing rates and to retard cooling of the printhead when idle or firing at a low rate.

In addition to mathematical analysis, direct numerical (computational) simulation also can be used to predict convective heat transfer. This procedure is commonly used and involves discretizing the thermal and hydrodynamic partial differential equations (i.e., approximating them with finite-difference equations) on a computational mesh (grid) that conforms to the geometric boundaries of the system. This results in a large system of coupled algebraic equations that can be solved using a digital computer.

Direct numerical simulation of the heat exchanger was accomplished using a commercial software package called Cosmos/M Flowstar (from Structural Research & Analysis Corporation, Santa Monica, California). The simulation represented a printhead having a swath of 0.5 inches and a single-sided heat exchanger operating at a printhead firing rate of 3.6 MHz and a power level of 18 W. Typical ink properties, printhead design parameters and operating conditions were employed. Eight sets of heat exchanger dimensions were used as test cases.

A residual heat fraction of unity (β=1) and an infinite thermal resistance between the printhead and its surroundings (r=∞) were assumed. Also, the simulation employed a representative value for the thermal conductivity of the silicon substrate ($k_s$=1.69 W/cm°C.) and solved for its temperature distribution. The results showed that the substrate temperature was nearly uniform as was assumed in the analysis. (This is to be expected since $k << k_s$.)

The computational results and the corresponding analytical results are presented in Table 2. The direct results of the simulation were the values of the steady-state printhead temperature rise, $\Delta T_{ps}$. The values of $(1/\beta)\theta_{ps}$ and the efficiency, E, were then inferred using Equations 13c and 20a (with R=∞). This is essentially opposite to the procedure used to obtain the analytical results. The computational and analytical predictions of both temperatures and pressures are in general agreement. The slight discrepancies can be attributed to the coarseness of the computational mesh that was used (e.g., 6 cells deep by 14 cells long for the channel in Case No. 4). This agreement indicates that the assumptions employed in the analysis but not the simulation are correct or at least valid approximations.

Of the cases considered in Table 2, Case No. 4 offers the best combination of efficiency, pressure drop, and length. Table 2 shows that, for this case, the reference value of the thermal resistance, $r_{ref}$, is approximately equal to 15° C./W. In the absence of a heat sink or insulation, the thermal resistance between the printhead and its surroundings (air and other parts of the writing system), r, is typically about 75° C./W. Hence, the non-dimensional thermal resistance has a value of approximately 5. Insulation (e.g., polystyrene or polyurethane foam) could increase the thermal resistance by a factor of 2 to 10.

TABLE 2

Printhead Performance Predictions

| Example ink properties: | Example printhead design parameters: | Example operating conditions (maximum output): |
|---|---|---|
| $\rho$ = 1.000 g/cm$^3$ | e = 5.000*10$^{-6}$ J | f = 3.600*10$^6$ sec$^{-1}$ |
| c = 4.180 J/g°C. | v = 3.000*10$^{-8}$ cm$^3$ | $q_{inp}$ = 18.00 W |
| k = 5.000*10$^{-3}$ W/cm°C. | $\Delta T_c$ = 39.87° C. | Q = 0.1080 cm$^3$/sec |
| $\alpha$ = 1.196*10$^{-3}$ cm$^2$/sec | $\Delta p_c$ = 10.00 cm $H_2O$ | Q' = 4.252*10$^{-2}$ cm$^2$/sec |
| $\mu$ = 3.000 cP = 3.000*10$^{-2}$ dyne*sec/cm$^2$ | = 9801 dyne/cm$^2$ | Re = 2.835 |
| Pr = 25.08 | b = 2.540 cm | |

| | Case Number | 1 | 2 | 3 | 4 | 5 | 6 | 7 | 8 |
|---|---|---|---|---|---|---|---|---|---|
| | d (cm) | 0.01016 | 0.01016 | 0.01016 | 0.01270 | 0.02032 | 0.03048 | 0.03048 | 0.03048 |
| | l (cm) | 0.200 | 0.300 | 0.400 | 0.280 | 0.300 | 0.200 | 0.300 | 0.400 |
| | u (cm/sec) | 4.185 | 4.185 | 4.185 | 3.348 | 2.093 | 1.395 | 1.395 | 1.395 |
| Computational | | | | | | | | | |
| | $\Delta p$ (cm $H_2O$) | 3.20 | 4.78 | 6.40 | 2.46 | 0.56 | 0.10 | 0.17 | 0.22 |
| SSHE | $\Delta T_{ps}$ (°C.) | 52.8 | 46.0 | 44.7 | 51.9 | 57.3 | 100.0 | 79.2 | 68.5 |
| $\beta$ = 1 | $(1/\beta)\Theta_{ps}$ | 1.324 | 1.154 | 1.121 | 1.302 | 1.437 | 2.508 | 1.986 | 1.718 |
| r = ∞ | E | 0.755 | 0.867 | 0.892 | 0.768 | 0.696 | 0.399 | 0.503 | 0.582 |
| Analytical | | | | | | | | | |
| | $\Delta p$ (cm $H_2O$) | 2.98 | 4.47 | 5.96 | 2.14 | 0.56 | 0.11 | 0.17 | 0.22 |
| | P | 0.298 | 0.447 | 0.596 | 0.214 | 0.056 | 0.011 | 0.017 | 0.022 |
| | D | 2.362 | 2.362 | 2.362 | 2.952 | 4.723 | 7.085 | 7.085 | 7.085 |
| | L | 1.308 | 1.962 | 2.616 | 1.831 | 1.962 | 1.308 | 1.962 | 2.616 |
| | A | 0.138 | 0.208 | 0.277 | 0.155 | 0.104 | 0.046 | 0.069 | 0.092 |
| | $r_{ref}$ (°C./W) | 16.00 | 10.67 | 8.00 | 14.29 | 21.33 | 48.00 | 32.00 | 24.00 |
| | $q_{ref}$ (W) | 2.492 | 3.738 | 4.984 | 2.791 | 1.869 | 0.831 | 1.246 | 1.661 |
| | F | 7.22 | 4.82 | 3.61 | 6.45 | 9.63 | 21.67 | 14.45 | 10.83 |
| SSHE | E | 0.767 | 0.881 | 0.939 | 0.802 | 0.674 | 0.427 | 0.543 | 0.635 |
| r = ∞ | $(1/\beta)\Theta_{ps}$ | 1.304 | 1.135 | 1.065 | 1.247 | 1.484 | 2.340 | 1.842 | 1.575 |
| $\beta$ = 1 | $\Delta T_{ps}$ (°C.) | 52.0 | 45.3 | 42.4 | 49.7 | 59.2 | 93.3 | 73.4 | 62.8 |
| $\beta$ = 0.5 | $\Delta T_{ps}$ (°C.) | 26.0 | 22.6 | 21.2 | 24.9 | 29.6 | 46.6 | 36.7 | 31.4 |
| DSHE | E | 0.986 | 0.998 | 1.000 | 0.992 | 0.960 | 0.774 | 0.887 | 0.944 |
| r = ∞ | $(1/\beta)\Theta_{ps}$ | 1.014 | 1.002 | 1.000 | 1.009 | 1.041 | 1.292 | 1.127 | 1.060 |
| $\beta$ = 1 | $\Delta T_{ps}$ (°C.) | 40.4 | 39.9 | 39.9 | 40.2 | 41.5 | 51.5 | 44.9 | 42.2 |
| $\beta$ = 0.5 | $\Delta T_{ps}$ (°C.) | 20.2 | 20.0 | 19.9 | 20.1 | 20.8 | 25.8 | 22.5 | 21.1 |

SSHE = Single-sided heat exchanger
DSHE = Double-sided heat exchanger

Table 3 gives values of the non-dimensional thermal resistance and the time constants for various values of the thermal resistance and the printhead thermal capacitance for case No. 4. The typical value of the printhead thermal capacitance, C=0.2 J/°C., corresponds to (for example) a printhead having a volume of 0.07 cm$^3$ and a mean heat capacity per unit volume approximately halfway between that of silicon (1.64 J/cm$^3$°C.) and water (4.18 J/cm$^3$°C.).

TABLE 3

Thermal Time Constants for Case No. 4

| r (°C./W) | R | C (J/°C.) | $\tau_{ref}$ (sec) | $T_0$ (sec) | $\tau_{min}$ (sec) SSHE | $\tau_{min}$ (sec) DSHE |
|---|---|---|---|---|---|---|
| 30 | 2.10 | 0.2 | 2.86 | 6 | 0.506 | 0.416 |
| | | 0.4 | 5.72 | 12 | 1.012 | 0.831 |
| | | 0.8 | 11.43 | 24 | 2.024 | 1.663 |
| 75 | 5.25 | 0.2 | 2.86 | 15 | .533 | .434 |
| | | 0.4 | 5.72 | 30 | 1.066 | .864 |
| | | 0.8 | 11.43 | 60 | 2.131 | 1.735 |

TABLE 3-continued

Thermal Time Constants for Case No. 4

| r (°C./W) | R | C (J/°C.) | $\tau_{ref}$ (sec) | $T_0$ (sec) | $\tau_{min}$ (sec) SSHE | $\tau_{min}$ (sec) DSHE |
|---|---|---|---|---|---|---|
| 150 | 10.50 | 0.2 | 2.86 | 30 | .543 | .440 |
| | | 0.4 | 5.72 | 60 | 1.055 | .880 |
| | | 0.8 | 11.43 | 120 | 2.170 | 1.760 |
| 300 | 20.99 | 0.2 | 2.86 | 60 | .547 | .443 |
| | | 0.4 | 5.72 | 120 | 1.095 | .887 |
| | | 0.8 | 11.43 | 240 | 2.190 | 1.773 |
| 750 | 52.48 | 0.2 | 2.86 | 150 | .550 | .445 |
| | | 0.4 | 5.72 | 300 | 1.101 | .891 |
| | | 0.8 | 11.43 | 600 | 2.202 | 1.781 |

Table 3, Equations 15a, 15b, 16a, and 16b and FIGS. 9D, 9E, 10D, and 10E indicate that, at low firing rates, considerable time is required for the printhead to reach its steady-state equilibrium temperature from a cold start, especially when the thermal resistance is high. This problem can be avoided by preheating the printhead to a predetermined "operating temperature" when the power is first turned on and after long idle periods. This can be accomplished using non-printing pulses, continuous power dissipation in the firing resistors, or a separate heating resistor and open-loop or closed-loop temperature control. In general, the warm-up time required depends on the printhead capacitance, the operating temperature, $T_{op}$, the initial temperature, $T_i$, the available preheating power, $q_{pre}$, and the thermal resistance between the printhead and its surroundings. If both the preheating power level and the thermal resistance are high (so that $q_{pre} >> q_{rej}$), then the preheating time interval, $$\Delta t_{pre} = \frac{C(T_{op} - T_i)}{q_{pre}} \tag{23a}$$

The operating temperature can be chosen in various ways, but if the value of R is high and the maximum value of F is low, an appropriate choice is $$T_{op} = T_0 + \beta \Delta T_0 \tag{23b}$$

Then $$\Delta t_{pre} = \frac{C}{q_{pre}} [\beta \Delta T_c - (T_i - T_0)] \tag{23c}$$

To avoid accidental ink drop ejections, ink spray, and ink deposits on the nozzle plate exterior, it is important that no vapor bubbles form in the printhead during preheating. The conditions under which vapor bubbles will form depend on the ink properties and printhead construction. However, typically this requirement restricts non-printing pulses to average power levels less than or comparable to the maximum average printing power. Continuous power dissipation in the firing resistors at approximately twice that level would probably be allowable because the maximum heat flux is much lower in this case. The heat flux can be further reduced using a separate heating resistor that covers a large area of the substrate. In this case the preheating power would be limited only by the surface area and the thermal diffusivity of the substrate and the ink. Thus, preheating power levels five to ten times greater than the maximum printing power might be possible. Table 4 gives preheating time intervals required for a 40° C. temperature change and various thermal capacitances and preheating power levels. (Maximum printing power=18 W.)

TABLE 4

Printhead Preheating Time Intervals

| Preheating Method | $q_{pre}$(w) | $\Delta t_{pre}$(sec) C = 0.2 J/°C. | $\Delta t_{pre}$(sec) C = 0.4 J/°C. | $\Delta t_{pre}$(sec) C = 0.8 J/°C. |
|---|---|---|---|---|
| Non-printing pulses to firing resistors | 10 | 0.80 | 1.60 | 3.20 |
| | 20 | 0.40 | 0.80 | 1.60 |
| Continuous power to firing resistors | 40 | 0.20 | 0.40 | 0.80 |
| Separate heating resistor | 100 | 0.08 | 0.16 | 0.32 |
| | 200 | 0.04 | 0.08 | 0.16 |

The following section describes the design and construction of a printhead embodying the theoretical principles previously discussed.

FIG. 2 is a drawing of a printhead 20 made according to the preferred embodiment of the invention. Unlike previously known printheads, it has low mass and volume since it does not need a heat sink, such as an integral ink reservoir. In the preferred embodiment of the invention, the ink reservoir remains stationary while printhead 20 moves back and forth across the page. Also, the ink-cooled printhead is thermally insulated from the other parts of the printer (including the ink reservoir) and the surrounding air as shown in FIG. 1. It has a heat exchanger with one active wall (i.e., a wall that transfers heat to the ink). The active wall is the printhead substrate 30 and the other (adiabatic) wall is insulator 24. Ink flows from an ink reservoir into an ink conduit 26. When the ink flow encounters insulator 24 it divides into two sections and each section flows around the insulator 24 and into heat exchanger 22. From heat exchanger 22 the ink flows through ink feed slot 38, shown in FIG. 3, and into firing chamber 40 where it receives direct heat from a firing resistor that ejects some of the ink though a nozzle 36 located in a nozzle plate 32. Outside insulation 28 thermally insulates the printhead from the other parts of the printer. For specified ink properties and flow rate, the efficiency of the heat exchanger (22 and 86) is determined by its dimensions (its length, l, depth, d, and width, w, as shown in FIGS. 2,3,4,5, and 6) and the number of active walls. The efficiency increases with the width of the heat exchanger and its length-to-depth ratio. (See Equation 4.) FIGS. 2, 3, and 4 show single-sided heat exchangers (which have one active wall) and FIGS. 5 and 6 show a double-sided heat exchanger (which has two active walls). Single-sided heat exchangers have the advantage of low thermal mass which allows them to warm up quickly. A double-sided heat exchanger has the advantage of being able to transfer more heat per unit length of the heat exchanger. A double-sided heat exchanger may be required when the printhead is not large enough to accommodate a single-sided heat exchanger having the desired efficiency.

For specified ink properties and flow rate, the pressure drop in the heat exchanger (22 and 86) is directly proportional to its length and inversely proportional to its width and the cube of its depth. (See Equation 5.) If the firing chambers are refilled by capillary pressure, the pressure drop in the heat exchanger must be relatively small to maintain an adequate refill rate.

Although the scope of the invention includes heat exchangers of arbitrary width, in the preferred embodiment of the invention, the width, w, of the heat exchanger 22 is approximately equal to the swath of printhead 20 (i.e., the distance between opposite ends of the nozzle array). The length, l, and depth, d, are chosen to produce a heat exchanger of high efficiency that will fit on a thermal ink jet printhead chip and causes minimal pressure drop in the ink that flows through it. In the preferred embodiment of the invention, the pressure drop in heat exchanger 22 should not exceed 2.5 cm of water so that it will not adversely affect the refill rate of the firing chamber.

The efficiency of the heat exchanger can be increased by lengthening the heat exchanger. However, the width of the chip constrains the length of heat exchangers 22. As shown in FIGS. 2–6, the length of heat exchanger 22 is close to one-half the width of the chip. To substantially increase the length of heat exchanger 22, the width of the chip would have to be increased at significant cost. Additionally, the pressure drop of in the heat exchanger is proportional to the length of the heat exchanger and lengthening the heat exchanger may cause the pressure drop to exceed 2.5 cm of water. Thus, the depth, d, of the heat exchanger 22 is the primary design variable.

The design of a heat exchanger that satisfies all of the above requirements is simplified with the use of FIGS. 8A and 8B. In the preferred embodiment the length of the heat exchanger, l, is in the range of 0.2 cm to 0.3 cm and its depth, d,is in the range of 0.010 cm to 0.015 cm.

The present invention includes all high-efficiency heat exchangers thermally coupled to the printhead substrate, and heat exchangers that have an efficiency high enough to eliminate the need for a heat sink are particularly important. Also important are heat exchangers that have an efficiency high enough to not only eliminate the heat sink but also allow the printhead temperature increment rise (above the inlet temperature) to stabilize at a low value somewhere near the product of the residual heat fraction and the characteristic temperature rise.

The efficiency of the heat exchanger will vary with the ink flow rate and hence will vary with the printhead firing rate. The greater the firing rate, the greater the flow, and the lower the efficiency. Conversely, the lower the firing rate, the lower the flow, and the higher the efficiency. The variations in the efficiency can be minimized by designing the heat exchanger so that it has a very high efficiency, such as 90%, at high flow rates so that when the flow rate decreases the maximum change in the efficiency is 10%.

The preferred embodiment has the advantage of a very brief warm-up transient because the thermal mass is limited essentially to the silicon and very thin layer of ink in the heat exchanger. With preheating, the warm-up time of the preferred embodiment ranges from 0.04 to 0.80 seconds depending on the preheating power level. For existing printheads, the warm-up time is 5 to 30 seconds. During this time, the user must either wait or tolerate inferior print quality.

FIG. 4 shows an alternate embodiment of the invention implemented in an edge-feed printhead. Heat exchanger 62 is identical to heat exchanger 22 shown in FIGS. 2 and 3 except that the ink flow path is different. Ink travels through ink conduit 26 until it strikes substrate 64. Then, the ink travels through heat exchanger 62 to the outer edges of the printhead die where it encounters firing chambers 72. Heat exchanger 62 has one active heat exchanger wall, substrate 64. The remaining walls are insulating walls 66. Like heat exchanger 22 shown in FIGS. 2 and 3 the width, w, of heat exchanger 62 equals the swath of the printhead die. The length, l, and depth, d, are the similar to those of heat exchanger 22 and are chosen to produce a heat exchanger having high efficiency and a pressure drop of 2.5 cm of water at the maximum flow rate.

Both heat exchanger 22 shown in FIG. 2 and 3 and heat exchanger 62 shown in FIG. 4 are single-sided heat exchangers which have one active wall. The length of the heat exchanger can be reduced by having two (or more) active walls. FIG. 5 shows a printhead with one section of outside insulation 92 removed to reveal a double-sided heat exchanger 86. A substrate 90 is one active heat exchanger wall and active heat exchanger wall 88 is the other. Ink flows through ink conduits 82 formed by insulator 84 and outside insulating wall 92. From heat exchanger 86 the ink flows through a central ink feed slot and into a firing chamber (not shown in FIG. 5 and 6 but similar to that shown in FIG. 3). FIG. 6 shows printhead 80 with a thermal conductor 94 that carries heat from substrate 90 to active heat exchanger wall 88. The width, w, length, l, and depth, d, of each half of the heat exchanger 86 and the width of the ink feed slot, $w_f$, are shown in FIGS. 5 and 6.

The double-sided heat exchanger could be made in three parts (one active heat exchanger wall 88 and two thermal conductors 94) as shown in FIGS. 5 and 6. Alternatively, thermal conductors 94 could be integral parts of substrate 90. In this case the ink flow channel of heat exchanger 86 would be cut (e.g., milled) in the bottom side of substrate 90. As another alternative, thermal conductors 94 could be integral parts of heat exchanger active wall 88. In this case the ink flow channel would be cut (e.g., milled) in the top side of heat exchanger active wall 88. Use of an adhesive of high thermal conductivity would help to minimize the thermal resistance of the joints.

The present invention includes heat exchangers of arbitrary geometry and arbitrary peripheral and axial distributions of temperature and heat flux. Heat exchangers that have fins located in the flow do not depart from the scope of the invention. The present invention also includes heat exchangers having multiple independent ink flow channels. A wide variety of heat exchangers can be designed and constructed using methods similar to those disclosed here. The magnitude of the pressure drop across the heat exchanger can vary without departing from the scope of the invention.

The foregoing description of the preferred embodiment of the present invention has been presented for the purposes of illustration and description. It is not intended to be exhaustive nor to limit the invention to the precise form disclosed. Obviously many modifications and variations are possible in light of the above teachings. The embodiments were chosen in order to best explain the best mode of the invention. Thus, it is intended that the scope of the invention to be defined by the claims appended hereto.

What is claimed is:

1. An apparatus for cooling a printhead in an ink-jet printer, said printhead ejects ink by having firing resistors therein heated with electrical printing pulses, comprising:

a) a plurality of the firing resistors located in firing chambers on a substrate in the printhead and in thermal communication with both the ink in the printhead and the substrate in the printhead, said firing resistors being subjected to a plurality of electrical printing pulses at selected firing rates, said firing resistors generate direct and residual heat from said electrical printing pulses, said direct heat being that heat directly transferred into the ink in the firing chambers from the firing resistors and said residual heat being that heat absorbed by the printhead substrate from the firing resistors; and b) a heat exchanger in thermal communication with both the printhead substrate and the ink for transferring heat from the printhead substrate to the ink flowing to the firing chambers, said heat exchanger having a flow path for the ink while in thermal communication therewith formed by two, substantially parallel, spaced apart, surfaces, at least one surface of which transfers heat absorbed by the printhead substrate to said ink, said two surfaces being spaced apart by a dimension of between about 0.010 cm and about 0.015 cm.

2. An apparatus, as in claim 1, wherein the flow path of said ink while in thermal communication with said heat exchanger has a length of between about 0.2 cm and about 0.4 cm.

3. An apparatus, as in claim 1, wherein the flow path of said ink while in thermal communication with said heat exchanger is substantially arcuate.

4. An apparatus, as in claim 1, wherein the flow path of said ink while in thermal communication with said heat exchanger is substantially planar.

5. An apparatus, as in claims 1, 2, 3, or 4 wherein the heat exchanger has no more than one surface which transfers the residual heat to the ink flowing to the firing chambers.

6. An apparatus, as in claims 1, 2, 3, or 4, wherein the heat exchanger has at least two surfaces that transfer the residual heat to the ink flowing to the firing chambers.

7. An apparatus, as in claim 5, having a non-dimensional thermal resistance, R, greater than 5, where $$R \equiv \frac{r}{r_{ref}} \quad \text{(Equation 13A)}$$

$$r_{ref} \equiv \frac{4d}{kbl} \quad \text{(Equation 12A)}$$

where r is the thermal resistance between the printhead and the ink-jet printer, d is the dimension said two surfaces forming the ink flow path are spaced apart, k is the thermal conductivity of the ink, l is the longitudinal dimension of the flow path of said ink while in thermal communication with said heat exchanger, and b is the total latitudinal dimension of the flow path of said ink while in thermal communication with said heat exchanger.

8. An apparatus, as in claim 5, having a non-dimensional thermal resistance, R, greater than 10, where $$R \equiv \frac{r}{r_{ref}} \quad \text{(Equation 13A)}$$

$$r_{ref} \equiv \frac{4d}{kbl} \quad \text{(Equation 12A)}$$

where r is the thermal resistance between the printhead and the ink-jet printer, d is the dimension said two surfaces forming the ink flow path are spaced apart, k is the thermal conductivity of the ink, l is the longitudinal dimension of the flow path of said ink while in thermal communication with said heat exchanger, and b is the total latitudinal dimension of the flow path of said ink while in thermal communication with said heat exchanger.

9. An apparatus, as in claim 5, having a non-dimensional thermal resistance, R, greater than 20, where $$R \equiv \frac{r}{r_{ref}} \quad \text{(Equation 13A)}$$

$$r_{ref} \equiv \frac{4d}{kbl} \quad \text{(Equation 12A)}$$

where r is the thermal resistance between the printhead and the ink-jet printer, d is the dimension said two surfaces forming the ink flow path are spaced apart, k is the thermal conductivity of the ink, l is the longitudinal dimension of the flow path of said ink while in thermal communication with said heat exchanger, and b is the total latitudinal dimension of the flow path of said ink while in thermal communication with said heat exchanger.

10. An apparatus, as in claim 6, having a non-dimensional thermal resistance, R, greater than 5, where $$R \equiv \frac{r}{r_{ref}} \quad \text{(Equation 13A)}$$

$$r_{ref} \equiv \frac{4d}{kbl} \quad \text{(Equation 12A)}$$

where r is the thermal resistance between the printhead and the ink-jet printer, d is the dimension said two surfaces forming the ink flow path are spaced apart, k is the thermal conductivity of the ink, l is the longitudinal dimension of the flow path of said ink while in thermal communication with said heat exchanger, and b is the total latitudinal dimension of the flow path of said ink while in thermal communication with said heat exchanger.

11. An apparatus, as in claim 6, having a non-dimensional thermal resistance, R, greater than 10, where $$R \equiv \frac{r}{r_{ref}} \quad \text{(Equation 13A)}$$

$$r_{ref} \equiv \frac{4d}{kbl} \quad \text{(Equation 12A)}$$

where r is the thermal resistance between the printhead and the ink-jet printer, d is the dimension said two surfaces forming the ink flow path are spaced apart, k is the thermal conductivity of the ink, l is the longitudinal dimension of the flow path of said ink while in thermal communication with said heat exchanger, and b is the total latitudinal dimension of the flow path of said ink while in thermal communication with said heat exchanger.

12. An apparatus, as in claim 6, having a non-dimensional thermal resistance, R, greater than 20, where $$R \equiv \frac{r}{v_{ref}} \quad \text{(Equation 13A)}$$

$$r_{ref} \equiv \frac{4d}{kbl} \quad \text{(Equation 12A)}$$

where r is the thermal resistance between the printhead and the ink-jet printer, d is the dimension said two surfaces forming the ink flow path are spaced apart, k is the thermal conductivity of the ink, l is the longitudinal dimension of the flow path of said ink while in thermal communication with said heat exchanger, and b is the total latitudinal dimension of the flow path of said ink while in thermal communication with said heat exchanger.

13. An apparatus, as in claim 1, further comprising a means for rapidly preheating the printhead including an electrical pulse generator connected to said firing resistors for generating heat therein, said pulse generator rapidly preheats the printhead at power-on or after long idle periods.

14. An apparatus, as in claim 13, wherein the generator electrically pulses the firing resistors with non-printing pulses.

15. An apparatus, as in claim 13, wherein the generator electrically pulses the firing resistors with a single pulse and produces heat dissipation in the firing resistors.

16. An apparatus, as in claim 1 further including an electrical pulse generator connected to a separate heating resistor for generating heat therein, said heating resistor being thermally coupled to the printhead substrate, said pulse generator rapidly preheats the printhead at power-on or after long idle periods.

17. Apparatus for cooling a print cartridge in an ink-jet printer, comprising:

(a) a plurality of firing resistors within the print cartridge which, when energized, selectively eject droplets of ink from the cartridge through nozzles, thereby generating heat within the print cartridge; and (b) a heat exchanger within the print cartridge in thermal communication with both the ink and the firing resistors for transferring firing resistor generated heat to said ink, said heat exchanger having thermally active surfaces and having an efficiency (E) of greater than about 85% and a dimensionless aspect variable (A) and a pressure drop (P) when $$A \text{ is defined as } A \equiv \frac{\alpha l}{4Q'd}$$

$$E \text{ is defined as } E \equiv \frac{T_1 - T_0}{T_w - T_0}$$

$$P \text{ is defined as } P \equiv \frac{\Delta p}{\Delta p_{ref}}$$

where l and d are the length and depth, respectively, of the heat exchanger, $\alpha$ is the thermal diffusivity of the ink, Q' is the volumetric flow rate per unit of channel width, $\Delta p$ is the pressure drop across the heat exchanger at maximum resistor firing rate, $\Delta p_{ref}$ is the reference pressure difference equal to the maximum capillary pressure rise across the nozzles, $T_1$ is the bulk temperature of the ink leaving the heat exchanger, $T_0$ is the temperature of the ink entering the heat exchanger, and $T_w$ is the temperature of the thermally active surfaces in the heat exchanger.

18. The heat exchanger of claim 17 wherein A for a double sided heat exchanger is greater than about 0.06 and P is less than about 0.25.

19. The heat exchanger of claim 17 wherein A for a single sided heat exchanger is greater than about 0.18 and P is less than about 0.25.

20. The heat exchanger of claim 17 having an effective length (l) of between about 0.2–0.3 cm and an effective depth (d) of between about 0.010–0.015 cm.

21. The heat exchanger of claim 17 having a thermally active, conductive member of substantially negligible thermal capacitance for transferring firing resistor generated heat to the ink.

22. The heat exchanger of claim 17 wherein the firing resistors are located in a linear array having a major axis perpendicular to the direction of flow of the ink in the heat exchanger.

23. The heat exchanger of claim 17 having a single, thermally active surface.

24. Apparatus for cooling a print cartridge in an ink-jet printer, comprising:

(a) a plurality of firing resistors with associated firing chambers within the print cartridge which, when energized, selectively eject droplets of ink from the cartridge, thereby generating heat within the print cartridge;

(b) a heat exchanger within the print cartridge in thermal communication with both the ink and the firing resistors for transferring firing resistor generated heat to said ink; and (c) a plurality of substantially adiabatic walls surrounding the heat exchanger and the firing resistors so that substantially all of the heat generated by the firing resistors is transferred to the ink proximate to the firing chambers.

25. The substantially adiabatic walls of claim 24 being fabricated from thermal insulating material so that the heat generated within the print cartridge is transferred away from the print cartridge as thermal energy in the ink droplets and with substantially negligible thermal convection from the print cartridge.

* * * * *